US006512895B2

(12) United States Patent
Sakurai et al.

(10) Patent No.: US 6,512,895 B2
(45) Date of Patent: Jan. 28, 2003

(54) PROCESS CARTRIDGE AND ELECTROPHOTOGRAPHIC IMAGE FORMING SYSTEM

(75) Inventors: Kazushige Sakurai; Toru Oguma; Hideki Matsumoto, all of Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/910,047

(22) Filed: Jul. 23, 2001

(65) Prior Publication Data

US 2002/0025174 A1 Feb. 28, 2002

(30) Foreign Application Priority Data

Jul. 28, 2000 (JP) ..... 2000-228510

(51) Int. Cl.[7] ..... G03G 15/00; G03G 15/04; G03G 15/08; G03G 21/16

(52) U.S. Cl. ..... 399/13; 399/27; 399/111; 399/119

(58) Field of Search ..... 399/13, 27, 29, 399/30, 111, 119

(56) References Cited

U.S. PATENT DOCUMENTS 5,923,917 A * 7/1999 Sakurai et al. ..... 399/27
6,021,291 A * 2/2000 Karakama et al. ..... 399/111 X
6,097,909 A 8/2000 Watanabe et al. ..... 399/111
6,128,452 A * 10/2000 Miyabe et al. ..... 399/111 X
6,163,665 A * 12/2000 Watanabe et al. ..... 399/111
6,253,036 B1 6/2001 Karakama et al. ..... 399/27
6,266,500 B1 7/2001 Numagami et al. ..... 399/104
6,272,299 B1 8/2001 Numagami et al. ..... 399/111
6,397,018 B1 * 5/2002 Matsumoto et al. ..... 399/27

* cited by examiner

*Primary Examiner*—Fred L Braun
(74) *Attorney, Agent, or Firm*—Fitzpatrick, Cella, Harper & Scinto

(57) ABSTRACT

A process cartridge is detachably mountable to both of an image forming apparatus of the electrode-rod-detection type and an image forming apparatus of the electrode-plate-detection type. The process cartridge has a photosensitive drum, a developing roller for developing an electrostatic latent image formed on the photosensitive drum, and a toner containing portion containing therein a toner to be used to develop the electrostatic latent image by the developing roller. The process cartridge further has an antenna rod having one end thereof exposed from a cartridge frame, and first to third electrodes including electrode plates. As a result, the process cartridge has the ability to be detachably mountable to both of the main body of the image forming apparatus of the electrode-rod-detection type and the main body of the image forming apparatus of the electrode-plate-detection type.

14 Claims, 13 Drawing Sheets

42
82a
82c
28
82b
83
13q
13h
13g
81
82
29
22b
11
11c
26a
42
22a
13f
26
11b
11a
22
13
82b
26c
82a
82c
13h
27
13q
24
25
13e
23
23b
90a
23a
90

PROCESS CARTRIDGE AND ELECTROPHOTOGRAPHIC IMAGE FORMING SYSTEM

BACKGROUND OF THE INVENTION

1. Field of the Invention

The invention relates to a process cartridge detachably mountable to an electrophotographic image forming apparatus and an electrophotographic image forming system, and particularly to a process cartridge detachably mountable to at least two kinds of electrophotographic image forming apparatuses differing in function from each other, and an electrophotographic image forming system using the process cartridge.

The electrophotographic image forming apparatus is an apparatus for forming an image on a recording medium by the use of the electrophotographic image forming process. Examples of the electrophotographic image forming apparatus include, for example, an electrophotographic copier, an electrophotographic printer (such as a laser beam printer or an LED printer), a facsimile apparatus and a word processor.

Also, the process cartridge refers to charging means, developing means or cleaning means and an electrophotographic photosensitive drum integrally made into a cartridge, which is made detachably mountable to the main body of the electrophotographic image forming apparatus, or at least one of charging means, developing means and cleaning means and an electrophotographic photosensitive drum integrally made into a cartridge, which is made detachably mountable to the main body of the electrophotographic image forming apparatus, or at least developing means and an electrophotographic photosensitive drum integrally made into a cartridge, which is made detachably mountable to the main body of the electrophotographic image forming apparatus.

2. Description of the Related Art

In the electrophotographic image forming apparatus using the electrophotographic image forming process, there is adopted a process-cartridge system in which an electrophotographic photosensitive member and process means for acting on the electrophotographic photosensitive member are integrally made into a cartridge, which is made detachably mountable to the main body of the electrophotographic image forming apparatus. According to this process cartridge system, the maintenance of the apparatus can be done by a user himself without resorting to a serviceman and therefore, the operability of the apparatus can be markedly improved. Therefore, this process cartridge system is widely used in the electrophotographic image forming apparatuses.

Also, in the electrophotographic image forming apparatus of the process cartridge type, as described above, the user himself interchanges the process cartridge and therefore, electrophotographic image forming apparatuses are provided with developer amount detecting means for informing the user when a developer (e.g. a toner) has been consumed. As this developer amount detecting means, there is a system for detecting any change in the capacitance among a plurality of electrodes disposed in the process cartridge to thereby detect the amount of developer.

As the constructions of these electrodes, there are an electrode-rod-detection type (a developer-remaining-amount-presence-or-absence detecting type) in which an electrode rod is disposed at a predetermined interval from a developer bearing member and the capacitance between it and the developer bearing member is detected, and an electrode-plate-detection type (a developer-remaining-amount-successively-detecting type) in which a plurality of electrode plates opposed to one another are disposed at locations into which a developer can go, and the capacitance between the electrode plates is detected.

Generally, developer amount detecting means of the above-described electrode-rod-detection type or the electrode-plate-detection type is alternatively provided in the process cartridge in accordance with the function of the main body of the image forming apparatus. Therefore, a process cartridge provided with the developer amount detecting means of the electrode-rod-detection type could be mounted only to an image forming apparatus for the electrode-rod-detection type, and a process cartridge provided with the developer amount detecting means of the electrode-plate-detection type could be mounted only to an image forming apparatus for the electrode-plate-detection type.

The present invention is a further development of the above-described related art.

SUMMARY OF THE INVENTION

It is an object of the present invention to provide a process cartridge detachably mountable to the main bodies of electrophotographic image forming apparatuses differing in function from each other, and an electrophotographic image forming system using the process cartridge.

It is another object of the present invention to provide a process cartridge capable of being mounted to the main body of an electrophotographic image forming apparatus having a function for successively detecting a remaining amount of developer (a developer-remaining-amount-successively-detecting function) and the main body of an electrophotographic image forming apparatus having a function for detecting that developer is consumed to a predetermined remaining amount (a developer-remaining-amount-presence-or-absence-detecting function), and an electrophotographic image forming system using the process cartridge.

It is another object of the present invention to provide a process cartridge detachably mountable to the main body of a first electrophotographic image forming apparatus and the main body of a second electrophotographic image forming apparatus differing in function from the first electrophotographic image forming apparatus and to provide an image forming system using the process cartridge, the process cartridge having (a) an electrophotographic photosensitive member, (b) a developing roller for developing an electrostatic latent image formed on the electrophotographic photosensitive member, (c) a developer containing portion for containing therein a developer to be used to develop the electrostatic latent image by the developing roller, (d) a first electrically conductive member disposed along the lengthwise direction of the developing roller and having one end thereof exposed from a cartridge frame, the one end being electrically connected to a first main body contact provided in the main body of the first electrophotographic image forming apparatus when the process cartridge has been mounted to the main body of the first electrophotographic image forming apparatus, and producing an electrical signal for indicating that the process cartridge has been mounted to the main body of the first electrophotographic image forming apparatus, the one end being not electrically connected to the interior of the main body of the second electrophotographic image forming apparatus when the process cartridge has been mounted to the main body of the second electrophotographic image forming apparatus, and (e) a second electrically conductive member disposed along the lengthwise direction of the developing roller and electrically connected to a cartridge electrical contact exposed from the cartridge frame, the cartridge electrical contact being electrically connected to a second main body contact provided in the main body of the second electrophotographic image forming apparatus when the process cartridge has been mounted to the main body of the second electrophotographic image forming apparatus, and producing an electrical signal for the main body of the second electrophotographic image forming apparatus to successively detect the remaining amount of the developer, the cartridge electrical contact being not electrically connected to the interior of the main body of the first electrophotographic image forming apparatus when the process cartridge is mounted to the main body of the first electrophotographic image forming apparatus.

These and other objects, features and advantages of the present invention will become more fully apparent upon consideration of the following description of the preferred embodiments of the present invention taken in conjunction with the accompanying drawings.

DESCRIPTION OF THE PREFERRED EMBODIMENTS

A description will hereinafter be provided of a process cartridge according to an embodiment of the present invention and an electrophotographic image forming apparatus using the same. Herein, an image forming apparatus A refers to an electrophotographic image forming apparatus for the electrode-rod-detection type, and an image forming apparatus A' refers to an electrophotographic image forming apparatus for the electrode-plate-detection type.

(Description of the Image Forming Apparatus and the Process Cartridge)

Figure 1:
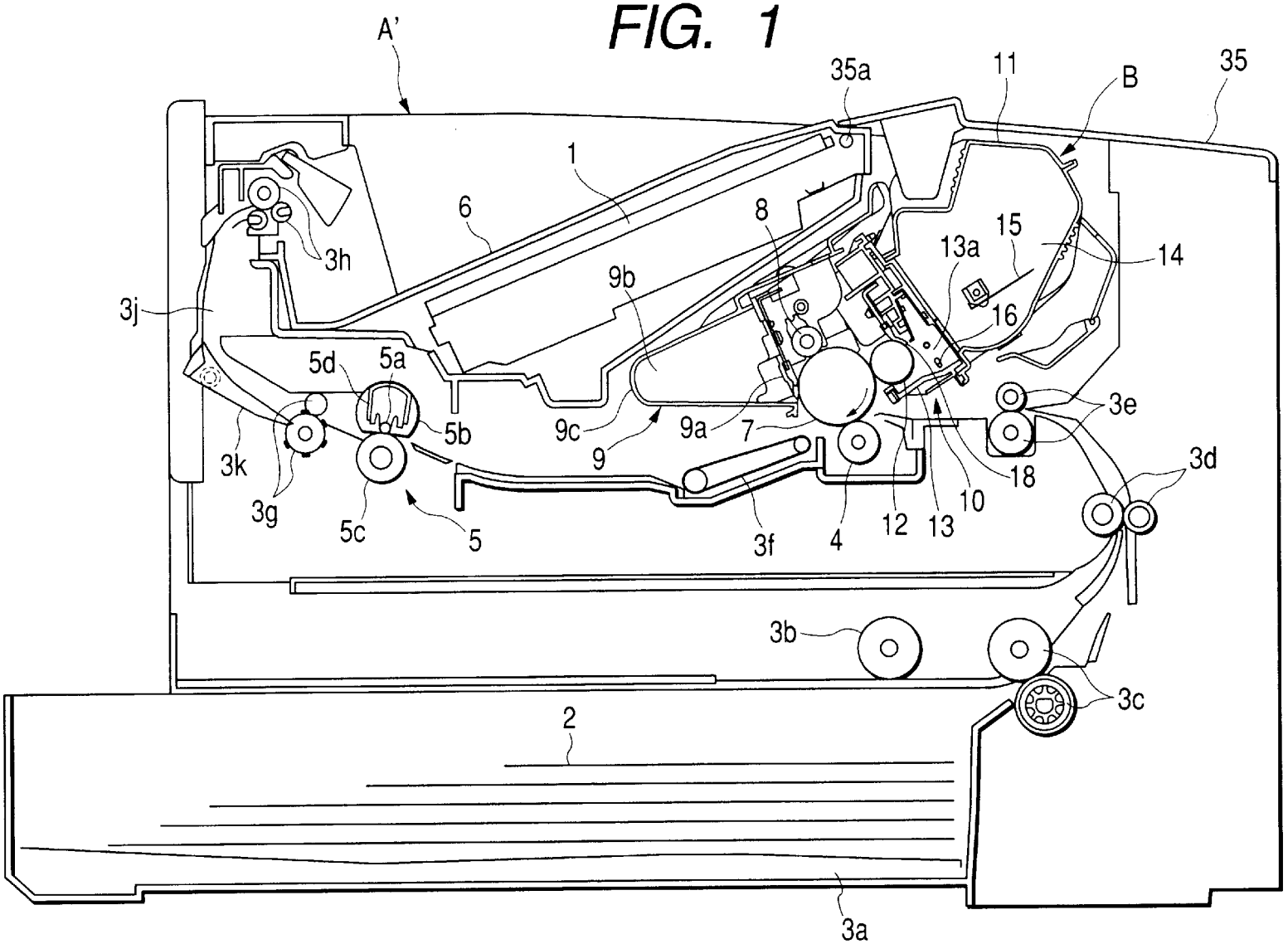
FIG. 1 is a schematic view showing in longitudinal cross-section a state in which a process cartridge is being mounted to an image forming apparatus provided with a successive toner-remaining-amount detecting circuit.

An example of the general construction of the electrophotographic image forming apparatus (hereinafter referred to as the image forming apparatus) will first be described with reference to FIG. 1. FIG. 1 is a schematic view showing the longitudinal cross-section of the image forming apparatus A' as it has the process cartridge B of the present invention mounted thereto.

A drum-shaped electrophotographic photosensitive member (hereinafter referred to as the photosensitive drum 7), which is a form of an image bearing member, is provided in the process cartridge B in the image forming apparatus A' . The photosensitive drum 7 is rotated in the direction indicated by the arrow in FIG. 1 and is charged by a charging roller 8 which is charging means. A laser beam conforming to image information is then applied from optical means 1 having a laser diode, a polygon mirror, a lens and a reflecting mirror to the photosensitive drum 7, whereby a latent image conforming to the image information is formed on the photosensitive drum 7. The latent image is developed by developing means 10 and is made into a toner image which is a visible image.

The developing means 10 comprises a developing roller 12, which is a developer bearing member, for feeding a developer (toner) to the photosensitive drum 7, and a developing blade 18, which is a regulating member for regulating the amount of the developer adhering to the surface of the developing roller 12. Also, the developing roller 12, the developing blade 18, a developing frame 13 holding them, and a toner container 11 (referred to also as a developer frame) containing the developer therein are coupled together to thereby constitute a developing unit 20, which is a developing device.

The developing roller 12 has its outer surface formed into a substantially cylindrical shape, is rotatably supported by a developing frame 13, and contains a stationary magnet 17 therein. The developing blade 18 is disposed at a suitable interval from and substantially in parallel to the developing roller 12. The toner container 11 forms a toner containing portion 14 containing therein a toner, which is the developer, and is provided with a toner feeding member 15 for feeding the toner in the toner containing portion 14. The toner feeding member 15 has a plastic sheet having flexibility and elasticity. The toner container 11 constitutes the toner containing portion 14, is secured to the developing frame 13, and supplies the toner in the toner containing portion 14 to the developing frame 13.

The developing frame 13 has a developing chamber 13*a*, and the toner in the toner containing portion 14 adjacent to the developing chamber 13*a* is fed to the developing chamber 13*a* by the rotation of a toner feeding member 15. The developing frame 13 is provided with a rotatable toner agitating member 16 near the developing roller 12, and causes the toner in the developing chamber 13*a* fed from the toner containing portion 14 to be circulated by the rotation of the toner agitating member 16. Also, the toner has magnetism and the developing roller 12 contains the stationary magnet 17 therein and therefore, the toner adheres onto the developing roller 12.

By the developing roller 12 being rotated, the toner is carried, and triboelectrification charges are induced by the blade 18 and also a toner layer of a predetermined thickness is formed on the developing roller 12, and the toner is carried to the developing area of the photosensitive drum 7. The toner supplied to the developing area is shifted to the latent image on the photosensitive drum 7 to thereby form a toner image on the photosensitive drum 7. The developing roller 12 is connected to a developing bias circuit provided in the main body of the image forming apparatus, and a developing bias voltage comprising a DC voltage superimposed on an AC voltage is usually applied thereto.

On the other hand, in synchronism with the formation of the toner image, a recording medium 2, such as paper set in a feed cassette 3*a*, is transported to a transfer position by a pickup roller 3*b*, a pair of transporting rollers 3*c* and 3*d*, and a pair of registration rollers 3*e*. A transfer roller 4 as transferring means is disposed at the transfer position, and a voltage is applied to the transfer roller 4, whereby the toner image on the photosensitive drum 7 is transferred to the recording medium 2.

The recording medium 2 having received the transfer of the toner image is transported to fixing means 5 by a transport guide 3*f*. The fixing means 5 is provided with a driving roller 5*c* and a fixing rotary member 5*b* comprising a cylindrical sheet containing a heater 5*a* therein and supported by a support member 5*d*, and applies heat and pressure to the recording medium 2 passing therethrough to thereby fix the transferred toner image on the recording medium 2.

The recording medium 2 on which the toner image has been fixed is transported by a pair of delivery rollers 3*g*, and is delivered to a delivery tray 6 by a pair of delivery rollers 3*h* via a surface reverse path 3*j*. The delivery tray 6 is provided on the upper surface of the image forming apparatus A' . It is also possible to operate a rockable flapper 3*k* to thereby deliver the recording medium 2 without the intermediary of the surface reverse path 3*j*. In the present embodiment, the pickup roller 3*b*, the pairs of transporting rollers 3*c* and 3*d*, the pair of registration rollers 3*e*, the transport guide 3*f*, and the pairs of delivery rollers 3*g* and 3*h* together constitute transporting means.

Also, the photosensitive drum 7 from which the toner image has been transferred to the recording medium 2 by the transfer roller 4 has any toner residual thereon removed by cleaning means 9, whereafter it is used for the next image forming process. The cleaning means 9 comprises an elastic cleaning blade 9*a* provided in abutting relationship with the photosensitive drum 7, and a removed toner reservoir 9*b* for containing the residual toner therein. The removed toner reservoir 9*b* is formed by a cleaning fame 9*c*, which in turn supports the cleaning blade 9*a*. The cleaning means 9 scrapes off the residual toner on the photosensitive drum 7 by the cleaning blade 9*a*, and collects it into the removed toner reservoir 9*b*.

Figure 2:
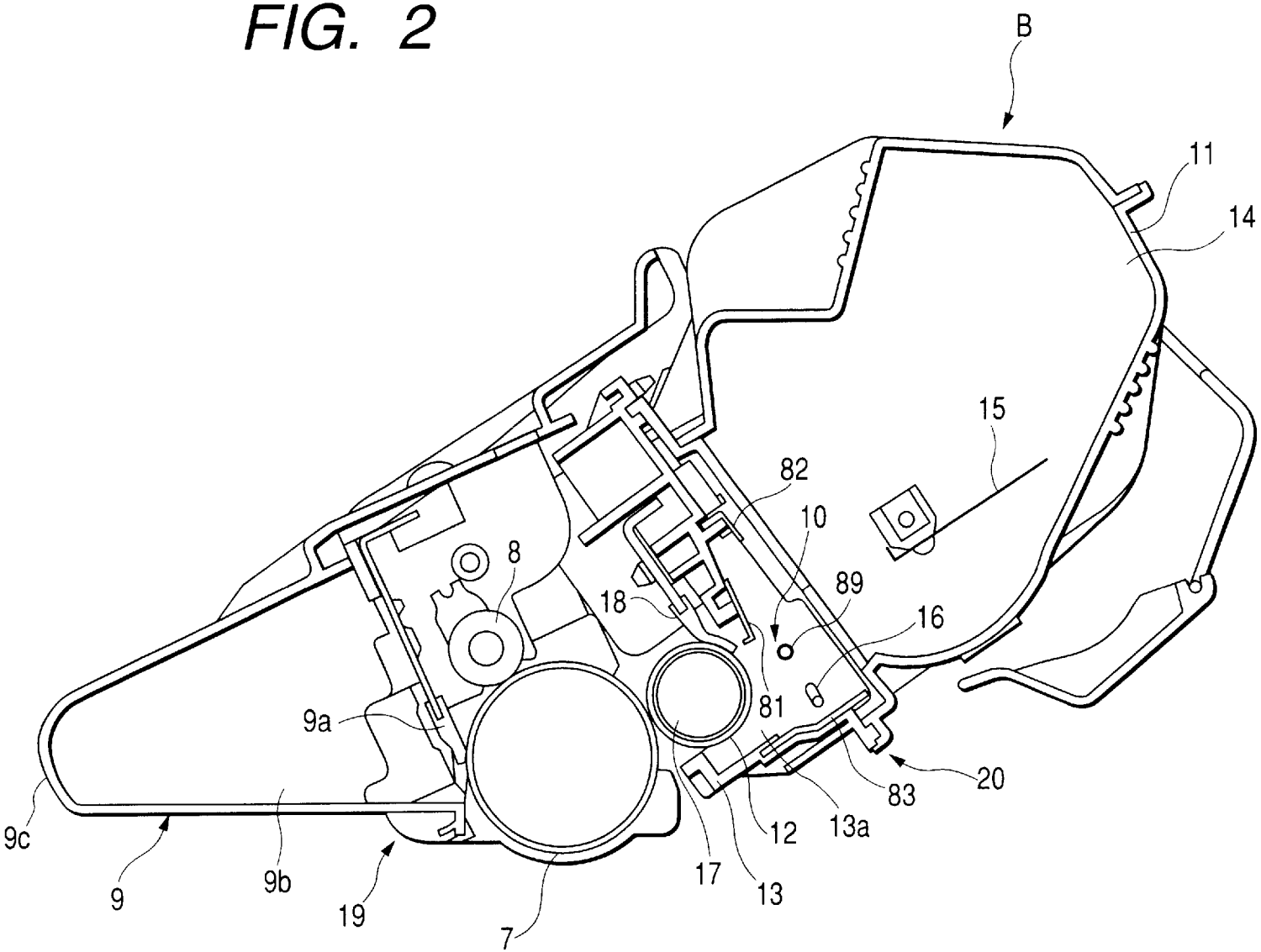
FIG. 2 is a longitudinal cross-sectional view of the process cartridge of the present invention.

On the other hand, as shown in FIG. 2, in the present embodiment, the process cartridge B forms the developing unit 20 (developing device) by the toner container 11 being welded to the developing frame 13 provided with the developing means 10. The toner container 11 forms the toner containing portion 14 containing the toner therein, and the toner feeding member 15 is pivotally supported in the toner containing portion 14. The developing frame 13 holds the developing roller 12 and the developing blade 18, which are the developing means 10.

Also, the cleaning means 9 such as the cleaning blade 9*a*, the photosensitive drum 7 and the charging roller 8 are supported by the cleaning frame 9*c* to thereby form a cleaning unit 19.

The process cartridge B is provided by the developing unit 20 and the cleaning unit 19 being rotatably coupled together into a unit and thereby made into a cartridge.

In the present embodiment, the process cartridge B is provided with first developer amount detecting means (hereinafter referred to as the first detecting means) for detecting the absence of the toner in the developing chamber 13*a*, and second developer amount detecting means (hereinafter referred to as the second detecting means) for successively detecting the remaining amount of the toner in accordance with the consumption of the toner in the developing chamber 13*a*.

(Description of the First Detecting Means (toner-remaining-amount-presence-or-absence detection))

The first detecting means will be described here. The first detecting means is detecting means of the electrode-rod-detection type, and as shown in FIG. 2, is comprised of a portion of an antenna rod 89, which is a metal wire formed of an electrically conductive material such as a non-magnetic stainless steel material or an aluminum material, provided along the lengthwise direction of the developing roller 12 and substantially in parallel to the developing roller 12. The antenna rod 89, if formed of one of electrically conductive materials, will act in the same way, but in the present embodiment, it uses a non-magnetic stainless steel material (SUS material) so as not to affect the circulation of the magnetic toner.

The antenna rod 89 is provided in the developing frame 13, and more particularly, is provided over the full length of the developing roller 12 and at a predetermined distance from the developing roller 12. The capacitance between the antenna rod 89 and the developing roller 12 is varied by the amount of toner present between the two. So, this variation in the capacitance is detected as a potential difference variation by a toner amount detecting contact in the main body of the image forming apparatus A for the electrode rod detection type to thereby detect the presence or absence of the remaining amount of toner.

Also, the capacitance between the antenna rod 89 and the developing roller 12 is detected to thereby judge whether the process cartridge B has been mounted to the main body of the image forming apparatus A. That is, when the process cartridge B has been mounted to the main body of the image forming apparatus A, the main body of the image forming apparatus A receives the capacitance between the antenna rod 89 and the developing roller 12 as an electrical signal, and detects that the process cartridge B has been mounted.

The antenna rod 89 forming the first detecting means does not successively detect the amount of toner, but effects the detection of the absence of the toner near the developing roller 12.

(Description of the Second Detecting Means (toner-remaining-amount successive detection))

The second detecting means will now be described. The second detecting means is detecting means of the electrode-plate-detection type, and in the present embodiment, as shown in FIG. 2, as measuring electrode members constituting the second detecting means, a first electrode 81, a second electrode 82, and a third electrode 83 are provided in the developing frame 13 and are disposed along and in parallel to the developing roller 12. The first to third electrodes 81, 82, and 83 are formed of a non-magnetic stainless steel material, an aluminum material, or electrically conductive resin, or the like. While in the present embodiment, the first to third electrodes 81, 82 and 83 comprising three electrode plates are provided as the measuring electrode members constituting the second detecting means, this is not restrictive, but the number of the electrodes may be one, two or four or more.

The first electrode 81 is provided near and along the developing roller 12, the third electrode 83 is provided at the bottom of the developing frame 13, and the first electrode 81 and the third electrode 83 are electrically connected together in the developing frame 13 and assume the same potential.

Also, the second electrode 82 is provided more toward the toner container 11 than the first electrode 81, and is disposed in the upper portion of the developing frame 13 so as to be opposed to the first electrode 81 and the third electrode 83. The second detecting means induces capacitance between the electrodes by a voltage being applied to one of the first electrode 81 and the second electrode 82, and is designed to measure the capacitance by a detecting circuit provided in the image forming apparatus A' (which will be described later) to thereby detect the amount of toner.

That is, the toner goes into between the electrodes, whereby the capacitance between the electrodes is varied and therefore, by detecting the variation, the amount of toner can be detected. In the present embodiment, a voltage is applied to the second electrode 82 to thereby make the second electrode 82 into an input side, and make the first electrode 81 and the third electrode 83 into an output side.

The first, second, and third electrodes 81, 82, and 83 are disposed at locations into which the toner carried from the toner container 11 by the toner feeding member 15 can go, and when the amount of toner in the process cartridge B is great, the toner is forced into the space surrounded by the electrodes by the toner feeding member 15 and therefore, the capacitance between the electrodes continues to exhibit a high value. However, as the process cartridge is used, the toner is consumed and the height of the toner between the second electrode 82 and the first electrode 81 and between the second electrode 82 and the third electrode 83 decreases, and the capacitance between the electrodes also decreases. From the decrease in the capacitance, the remaining amount of toner is successively detected.

Finally, the toner near the fore end of the developing blade 18, which scrapes off the toner on the surface of the developing roller 12, is consumed, whereby a blank area on an image is created to thereby bring about a toner-absent state. In the present embodiment, the developing bias voltage applied to the developing roller 12 is used as an input voltage and the capacitance between the developing roller 12 and the first electrode 81 (and the third electrode 83) is also detected to thereby detect the toner-absent state. That is, the second detecting means can detect any variation in the capacitance among a plurality of electrodes to thereby successively detect the amount of toner.

The process cartridge of the present embodiment is provided with two developer amount detecting means as described above, whereby it is adapted to be capable of coping with any one of the main body of an image forming apparatus of a type having a mechanism for successively detecting the amount of toner and the main body of an image forming apparatus of a type having no successively detecting mechanism and effecting only the detection of the absence of the toner.

(Description of the Detecting Circuit)

Figure 3:
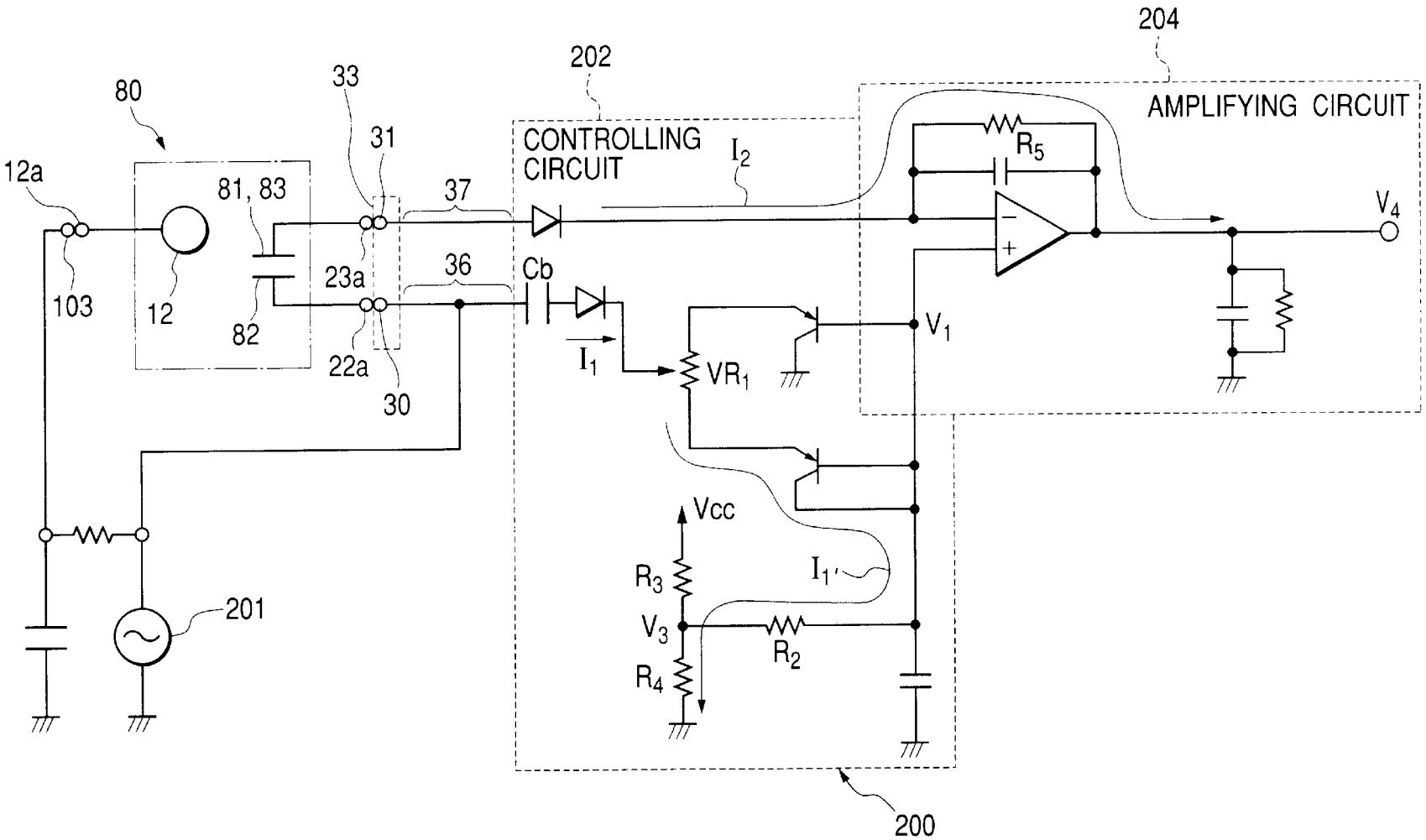
FIG. 3 is a circuit diagram showing an example of a developer-amount detecting circuit for detecting the capacitance with which developer amount detecting means has been charged.

FIG. 3 is a circuit diagram showing an example of the developer amount detecting circuit for detecting the amount of developer in the image forming apparatus A' and the process cartridge B.

The developer amount detecting circuit 200 comprises a detecting portion 80, a developing bias circuit 201, a controlling circuit 202, and an amplifying circuit 204. The detecting portion 80 comprises the first, second, and third electrodes 81, 82 and 83, which are the first detecting means, and the developing roller 12, and induces a capacitance to detect the amount of toner. This detecting portion 80 is provided in the process cartridge B.

On the other hand, the developing bias circuit 201, the controlling circuit 202 and the amplifying circuit 204 are provided in the main body of the image forming apparatus A'.

External contacts 22*a* and 23*a*, which are electrical contacts with the image forming apparatus A', are provided on a side of the frame of the process cartridge B, and when the process cartridge B is mounted to the main body of the image forming apparatus A', the external contacts 22*a* and 23*a* contact electrical contacts 30 and 31, respectively, provided on the image forming apparatus A' side.

The capacitance Ca of the detecting portion 80 is the capacitance between the second electrode 82 and the first electrode 81 and between the second electrode 82 and the third electrode 83, and the magnitude thereof fluctuates in conformity with the amount of toner.

The detecting portion 80 has one input side electrode thereof as an impedance element connected to the developing bias circuit 201, which is developing bias applying means, and the controlling circuit 202. In the present embodiment, the second electrode 82 is an input side electrode, and the second electrode 82 is connected to the developing bias circuit 201 through the external contact 22*a* and the electrical contact 30 of the main body of the image forming apparatus A', and is connected to the controlling circuit 202 via a wire laying portion 36 for electrical wires in the main body of the image forming apparatus A'.

The detecting portion 80 has its other output side electrode connected to the controlling circuit 202. In the present embodiment, the first and third electrodes 81 and 83 are connected to the controlling circuit 202 through the external contact 23*a* and the electrical contact 31 of the main body of the apparatus and via a wire laying portion 37 for the wires in the main body of the image forming apparatus A'.

The process cartridge B is provided with a developing bias contact 12*a*, which conducts with the developing roller 12, and the image forming apparatus A' is provided with a developing contact member 103 which conducts with the developing bias circuit 201. When the process cartridge B is mounted to the image forming apparatus A', the developing bias contact 12*a* and the developing contact member 103 provided in the image forming apparatus A' are electrically connected together, and a developing bias voltage is applied from the developing bias circuit 201 of the image forming apparatus A' to the developing roller 12 via the developing contact member 103 and the developing bias contact 12*a*.

A reference capacitance element Cb is provided in the controlling circuit 202 and is connected to the developing bias circuit 201 in the image forming apparatus A'. The reference capacitance element Cb sets a reference voltage $V_1$, which becomes the reference in detecting the amount of toner, by the use of an AC (alternating current) $I_1$ applied from the developing bias circuit 201. The controlling circuit 202 divides the AC $I_1$ applied to the reference capacitance element Cb by a volume $VR_1$, and adds a voltage drop $V_2$ occurring in a resistor $R_2$ by the divided AC $I_1'$ to a set voltage $V_3$ set by a resistor $R_3$ and a resistor $R_4$ to thereby determine a reference voltage $V_1$.

The amplifying circuit 204 is provided with a comparator for calculating the difference between voltages, and an AC $I_2$ applied to the detecting portion 80 is inputted to the amplifying circuit 204 and is outputted as the detected value $V_4(=V_1-I_2\times R_5)$ of the amount of toner. The remaining amount of toner is detected on the basis of this detected value $V_4$ which is the difference from the reference voltage $V_1$. The information of the thus detected remaining amount of toner is reported to an operator (user) as by an indicating portion (not shown) provided in the main body of the image forming apparatus A'.

According to the image forming apparatus A' of the present invention, the remaining amount of toner in the process cartridge B is successively detected by the second detecting means and on the basis of the information thereof, the consumed amount of toner is indicated, whereby the user can be pressed for the preparation of a fresh process cartridge or a supply cartridge. Further, the user can be pressed for the interchange of the process cartridge or the supply of the toner by the detection information of the absence of the toner.

(Description of the Attachment of the Electrodes and the Antenna Rod)

A description will now be made of the structure for attaching the antenna rod 89, which is the first detecting means, and the first electrode 81, the second electrode 82, and the third electrode 83, which are the second detecting means, to a portion constituting the developing device.

The second detecting means comprising the first electrode 81, the second electrode 82, and the third electrode 83, is realized by detecting the capacitance of the space surrounded by the second electrode 82 and the first and third electrodes 81 and 83 and therefore, the positional accuracy of each electrode is very important. Also, the first detecting means is realized by detecting the capacitance between the antenna rod 89 and the developing roller 12 and therefore, the positional accuracy of the antenna rod 89 is also very important. Particularly the intervals among the respective electrodes 81, 82, and 83 and the positions of the respective electrodes relative to the developing roller 12 and the developing blade 18 need be accurately determined in order to detect the amount of toner accurately. Also, in the present invention, it is necessary to dispose each electrode nearer to the developing roller 12 on which the toner remains to the last in order to accurately detect the time when the toner is exhausted and a blank area on an image is created.

Figure 4:
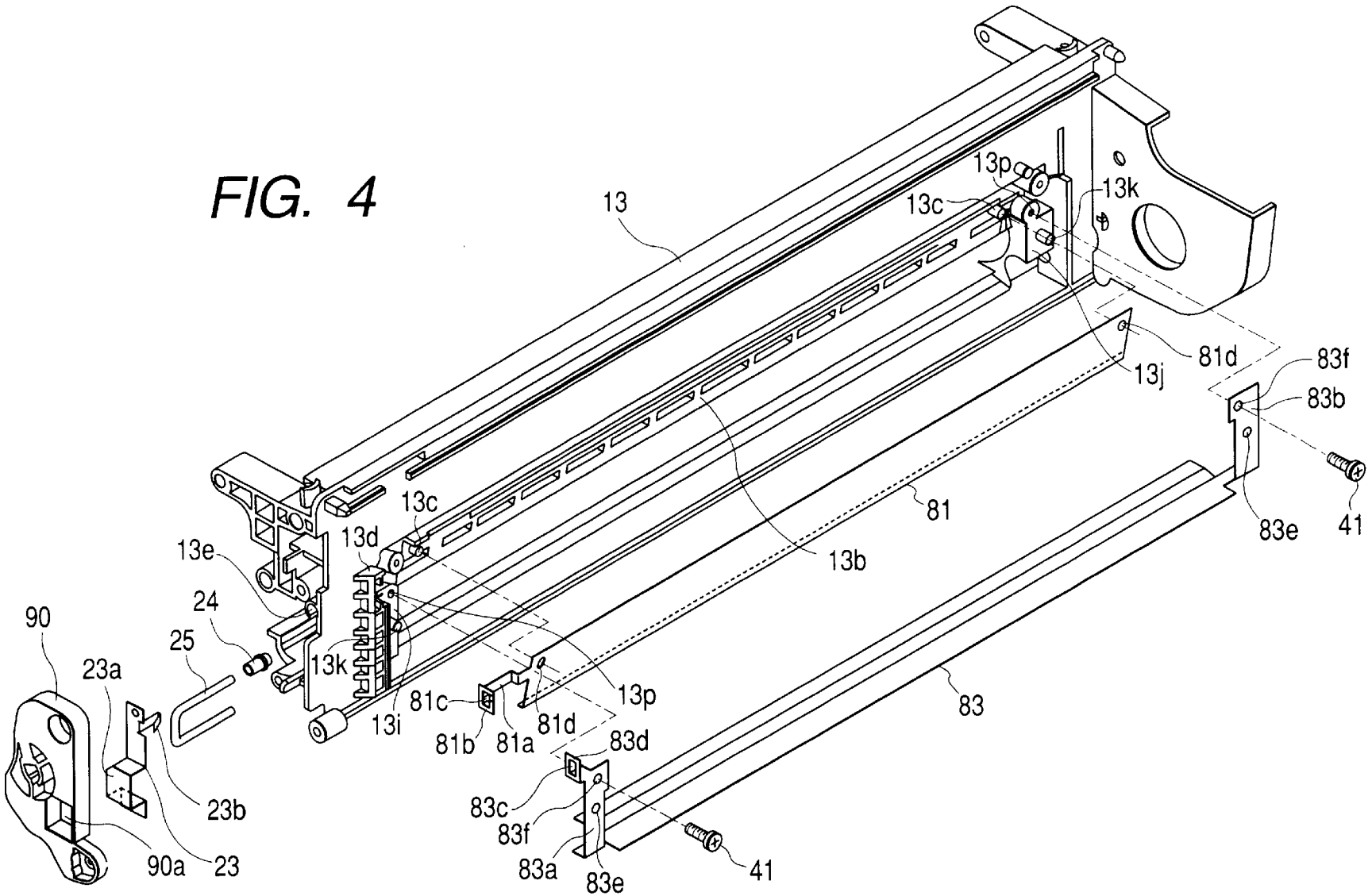
FIG. 4 is an exploded perspective view showing the manner in which a first electrode and a third electrode are attached to a developing frame.
Figure 5:
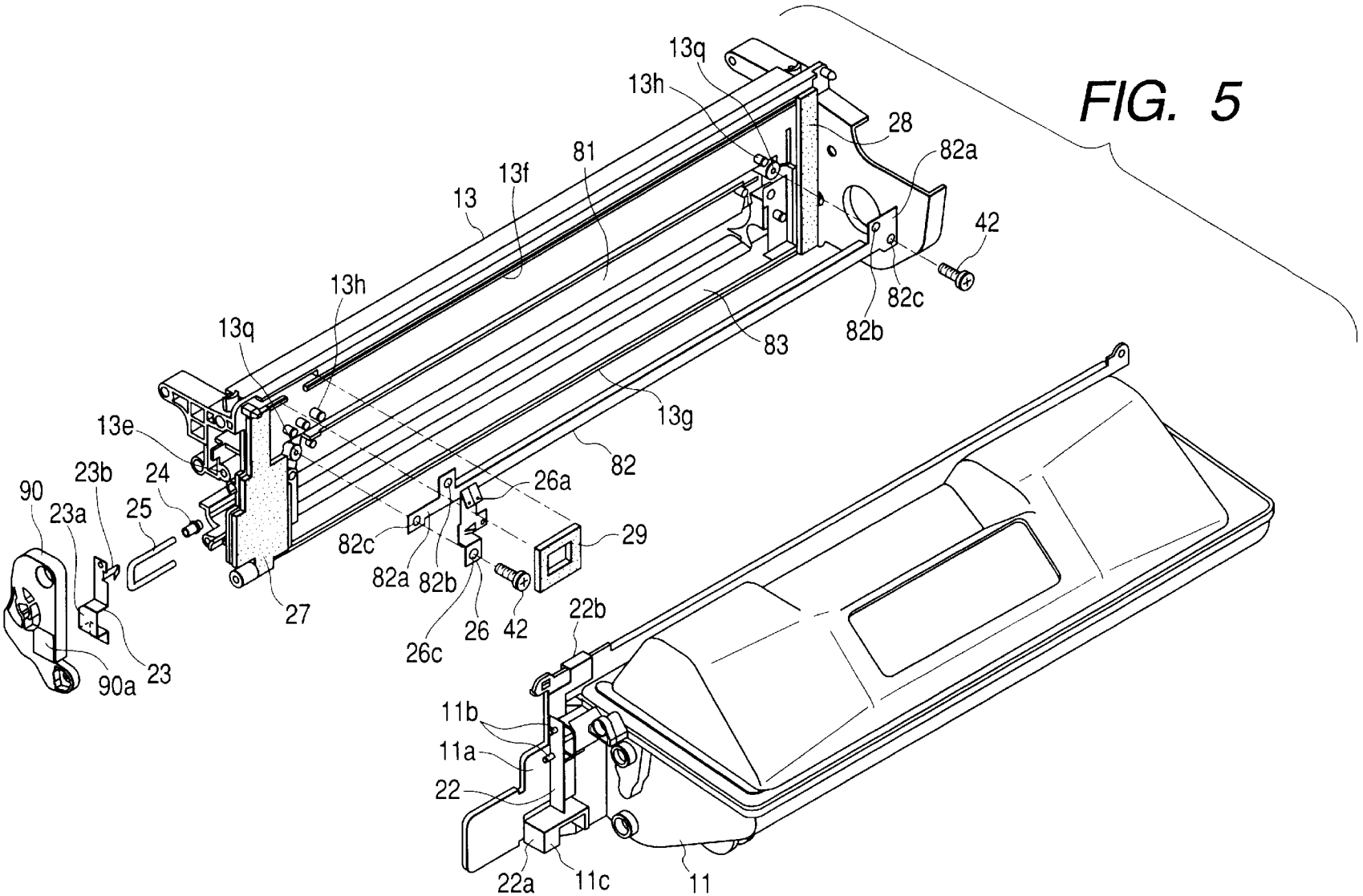
FIG. 5 is an exploded perspective view showing the manner in which a second electrode is attached to the developing frame.

So, in the present embodiment, as shown in FIGS. 4 and 5, the electrodes 81, 82, 83 and the antenna rod 89 are attached to the developing frame 13.

FIG. 4 is an exploded perspective view showing the manner in which the first electrode 81 and the third electrode 83 are attached to the developing frame 13. As shown in FIG. 4, the first electrode 81 forms a thin plate-like shape and is of a shape in which a side (lower side) thereof is bent substantially at a right angle with some width given thereto. Positioning apertures 81*d* for positioning bosses 13*c* to fit thereto are formed in the opposite ends of the first electrode 81. One end portion (the end portion on this side as viewed in FIG. 4) of the first electrode 81 is provided with an arm portion 81*a* narrower in width than the first electrode 81 and bent into a crank-like shape toward the developing frame 13 on the lengthwise extension of the first electrode. Further, the end portion of the arm portion 81*a* is formed with an incised clinch 81*b*, which is an electrical connecting portion having its plate surface bent at 90° with respect to the plate surface of the first electrode 81, and the incised clinch 81*b* is formed with an aperture 81*c*. The plate surface of the end portion of the arm portion 81*a* is also orthogonal to an attachment surface 13*b* to which the first electrode 81 is attached, and has a vertical plate surface.

The first electrode 81 is made parallel to the lengthwise direction of the developing frame 13 and is moved in the widthwise direction of the developing frame 13, and the positioning bosses 13*c* provided on the opposite end portions of the attachment surface 13*b* formed on the developing frame 13 are fitted to the positioning apertures 81*d* formed in the first electrode 81 to thereby position the first electrode, which is then stuck on the attachment surface 13*b* by an adhesive double coated tape. The electrode attaching method is not restricted to the adhesive double coated tape, but yet it is difficult in some cases to secure a space for screwing in the developing frame 13 because in order to reliably detect a blank area on an image, the first electrode 81 is provided near the developing roller 12 and the developing blade 18 on which the toner is lastly consumed. Therefore, in the present embodiment, use is made of the fixing by the adhesive double coated tape, which does not require such a space.

Figure 10:
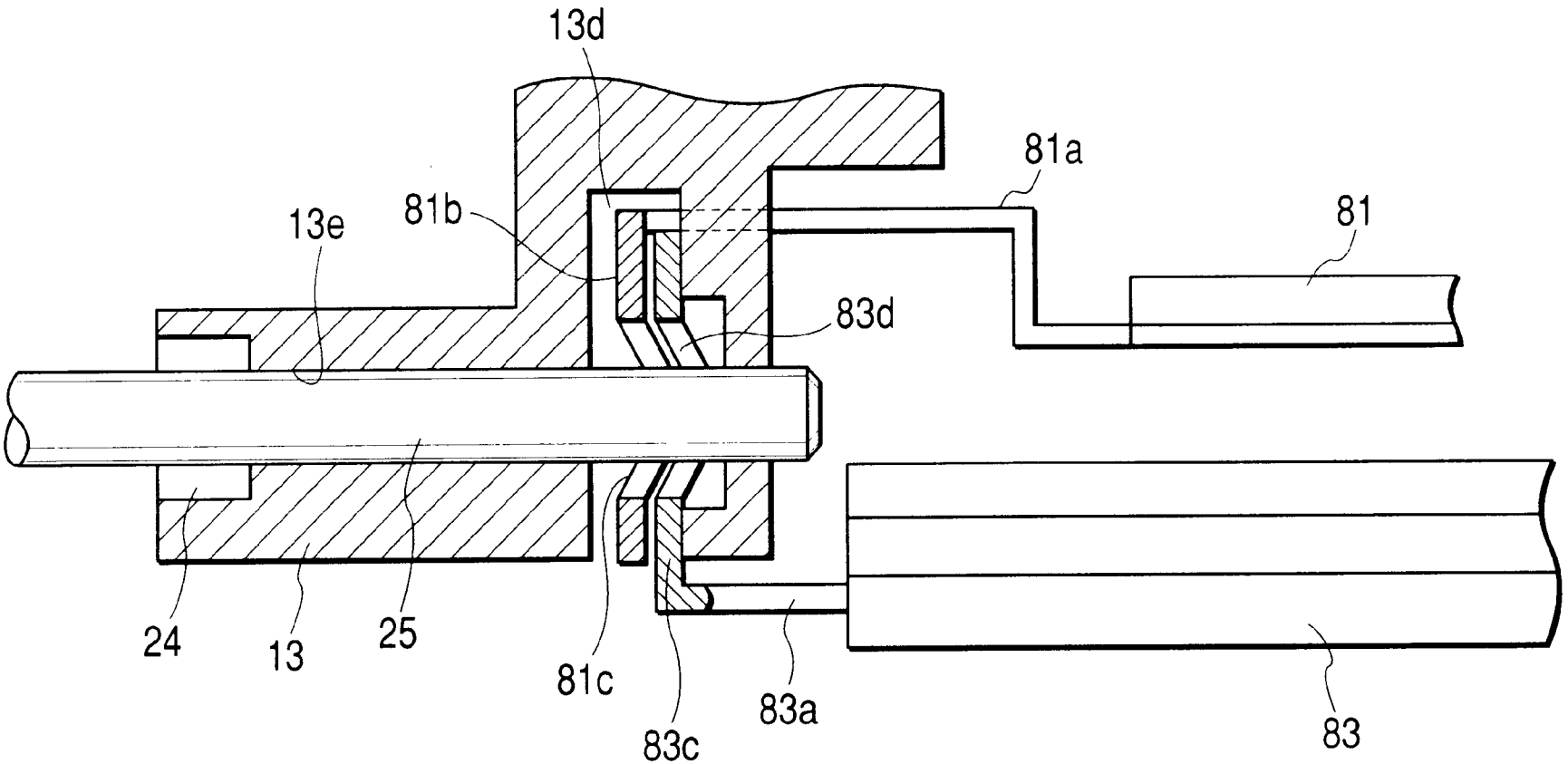
FIG. 10 is a plan view showing the connected portions of the first electrode and the third electrode.

Also, the developing frame 13 is formed with a groove 13*d* long in a direction substantially orthogonal to the attachment surface 13*b* (see FIG. 10). When the first electrode 81 is stuck on the attachment surface 13*b* and is attached to the developing frame 13, the end portion of the arm portion 81*a* having the incised clinch 81*b* is adapted to go into the groove 13*d* of the developing frame 13. Laterally of the groove 13*d* of the developing frame 13, there is formed a tunnel 13*e* extending from the interior of the developing frame 13 toward the exterior of the developing frame 13, and the location of the tunnel 13*e* is determined so as to align with the aperture 81*c* in the incised clinch 81*b* when the first electrode 81 is attached to the developing frame 13.

The third electrode 83 forms a thin plate-like shape, and the opposite end portions thereof are formed with arm portions 83*a* and 83*b*. The arm portions 83*a* and 83*b* are bent in a direction substantially orthogonal to the plate surface of the third electrode 83, and the arm portions 83*a* and 83*b* are formed with positioning apertures 83*e* for positioning bosses 13*k* to fit thereto and screw apertures 83*f*. Also, the end portion of the arm portion 83*a* is formed with an incised clinch 83*c* (electrical connecting portion) similar in shape to the incised clinch 81*b* of the first electrode 81, perpendicularly to the plate surface of the arm portion 83*a* and the plate surface of the third electrode 83.

To attach the third electrode 83 to the developing frame 13, the third electrode 83 is moved in the widthwise direction of the developing frame 13, the positioning apertures 83*e* of the arm portions 83*a* and 83*b* are fitted on the positioning bosses 13*k*, and are brought into abutting relationship with the attachment portions 13*i* and 13*j* of the developing frame 13, and small screws 41 are screwed into the screw apertures 83*f* and internally threaded holes 13*p* to thereby fix the third electrode. At this time, the end portion of the arm portion 83*a* having the incised clinch 83*c* fits into the groove 13*d* of the developing frame 13. The incised clinch 83*c* is formed with an aperture 83*d* so that the incised clinch 83*c* and the incised clinch 81*b* may form a line when the third electrode 83 is attached to the developing frame 13.

As shown in FIG. 10, after the attachment of the first electrode 81, the third electrode 83 is attached to the developing frame 13 and is assembled, whereupon the incised clinch 83*c* thereof comes into contact with the arm portion 81*a* of the first electrode 81 and the arm portion 81*a* is flexed, and in this state, the aperture 83*d* and the aperture 81*c* are adapted to overlap each other. That is, the incised clinch 83*c* of the third electrode 83 corrects the position of the incised clinch 81*b* of the first electrode 81 to thereby improve the assembling property for the pressfit of the electrode rod 25 thereafter.

Also, the tunnel 13*e* of the developing frame 13 is of a shape in which an elastic seal member 24 is fitted therein, and the elastic seal member 24 is forced thereinto from the outside of the developing frame 13. One end of a columnar electrode rod 25 formed into a U-shape is inserted into the tunnel 13*e* of the developing frame 13 through the elastic seal member 24, and is forced into the aperture 81*c* and the aperture 83*d* in the developing frame 13, whereby the first electrode 81 and the third electrode 83 are electrically connected together.

A holder 90 for rotatably supporting the developing roller 12 by a bearing portion is mounted on a side of the developing frame 13. A portion of an electrode plate 23 is fitted to a square window portion 90*a* provided in the holder 90 to thereby constitute an external contact 23*a* for electrically connecting the image forming apparatus and the process cartridge B together. The electrode plate 23 is provided with a contact portion 23*b*, and when the holder 90 is mounted on the developing frame 13, the contact portion 23*b* contacts with the electrode rod 25, whereby the external contact 23*a*, the first electrode 81 and the third electrode 83 are electrically connected together.

FIG. 5 is an exploded perspective view showing the manner in which the second electrode 82 is attached to the developing frame 13. As shown in FIG. 5, the second electrode 82 forms a shape in which a thin plate is bent substantially at a right angle, and arm portions 82*a* are formed on the opposite ends thereof. The arm portion 82*a* of the second electrode 82 are formed with positioning apertures 82*b* for positioning bosses 13*h* provided on the developing frame 13 to fit thereinto and screw holes 82*c*.

When the second electrode 82 is to be attached to the developing frame 13, the positioning bosses 13*h* of the developing frame 13 are fitted into the positioning apertures 82*b* of the second electrode 82 to thereby position the second electrode, and small screws 42 are screwed into the screw holes 82*c* and into the internally threaded holes 13*q* of the developing frame 13 to thereby fix the second electrode. At this time, one small screw 42 (this side as viewed in FIG. 5) is inserted into the screw hole 26*c* of an electrode plate 26 to thereby fasten the electrode plate 26 with the second electrode 82, and the wiring to the outside of the developing frame 13 is effected by the electrode plate 26. The second electrode 82 should desirably be assembled after the attachment of the first electrode 81 so as not to spoil the assembling property of the first electrode 81.

As previously described, the second electrode 82 differs in potential from the first and third electrodes 81 and 83 and therefore, if in case of the wiring to each electrode, the electrode plates for wiring are disposed in opposed relationship with each other, a capacitance will be induced between the electrode plates for wiring and this will cause a lowering of the accuracy of toner-remaining-amount detection. The electrode plate 26 is an electrode plate for the wiring to the second electrode 82 and therefore, the wiring from the developing frame 13 to the toner container 11 is effected by the electrode plate 26 so that the electrode plate 23 for the wiring to the first and third electrodes 81 and 83 may not be disposed at a location opposed to the electrode plate 26. Herein, the electrode plate for wiring refers to an electrode plate used as wiring for transmitting electricity.

Figure 9:
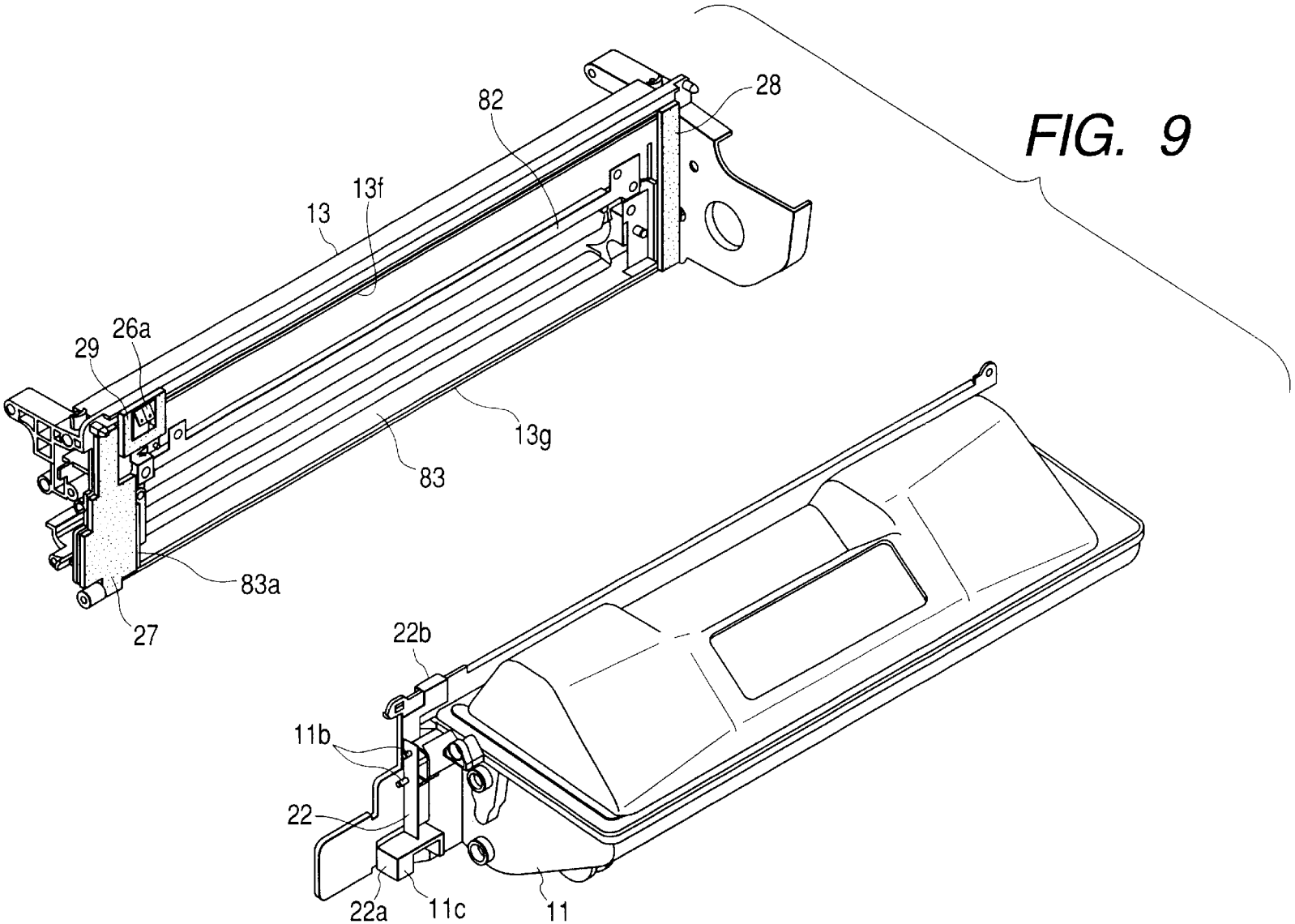
FIG. 9 is an exploded perspective view for showing the manner in which the developing frame and a toner container are coupled together after the first to third electrodes have been attached to the developing frame.

The coupling construction for the developing frame 13 and the toner container 11 forming the toner containing portion 14 will now be described with reference to FIG. 9. FIG. 9 is a perspective view showing the manner in which the developing frame 13 and the toner container 11 are coupled together after the first to third electrodes 81, 82 and 83 have been attached to the developing frame 13.

As shown in FIG. 9, convex portions 13*f* and 13*g* for fitting into concave grooves for coupling (not shown) formed in the toner container 11 are provided on the joined surface of the developing frame 13 with the toner container 11. The convex portions 13*f* and 13*g* are long in the lengthwise direction of the developing frame 13 in the upper and lower portions thereof, and are parallel to each other. Triangular ribs used for ultrasonic welding are provided on the top surfaces of these convex portions 13*f* and 13*g*.

Also, seal members 27 and 28 are stuck on the opposite end portions of the developing frame 13 so as to prevent the leakage of the toner from between the developing frame 13 and the toner container 11. Also, a seal member 29 is stuck so as to surround the contact portion 26*a* of the electrode plate 26 so that the toner may not leak from around the electrode plate 26 for the wiring to the toner container 11. These seal members 27, 28 and 29 use a sponge-like material having elasticity.

The developing frame 13 into which each part has been incorporated and the toner container 11 are pressed with the concave grooves of the toner container 11 and the convex portions 13*f* and 13*g* of the developing frame 13 fitted together, and further, ultrasonic vibration is applied between the concave grooves and the convex portions. Thereupon, the triangular ribs provided on the convex portions 13*f* and 13*g* are melted by the ultrasonic vibration and are welded to the bottoms of the concave grooves, whereby the developing frame 13 and the toner container 11 are integrally coupled together.

In the present construction, an electrode plate 22 for wiring is attached to the toner container 11. The electrode plate 22 is provided with an external contact 22*a* for connection to the main body of the image forming apparatus, and a contact portion 22*b* for connection to the electrode plate 26. The electrode plate 22 is attached to the outer side of the toner container 11. The contact portion 22*b* of the electrode plate 22 is provided on the end of a portion nipping the upper edge of the flange 11*a* of the toner container 11, and is disposed at a location opposed to the contact portion 26*a*. The electrode plate 22 is disposed along the outer side of the flange 11*a* of the toner container 11, and is fitted into and fixed to a dowel 11*b* protruding from the toner container 11 outwardly in the lengthwise direction thereof. The external contact 22*a* is disposed along the contact seat 11*c* of the toner container 11, and that surface of the external contact 22*a* which provides a contact, like the external contact 23*a*, faces outwardly in the lengthwise direction thereof.

The electrical connection between the electrode plate 22 and the electrode plate 26 is made by the contact between the contact portion 22*b* and the contact portion 26*a*, and they contact with each other and are electrically connected together when the developing frame 13 and the toner container 11 are coupled together.

The electrode plate 22 has its plate surface disposed so as to be substantially orthogonal to the plate surface of the arm portion 83*a* of the third electrode 83, and it is avoided for the both plate surfaces to be opposed to each other, whereby a capacitance is prevented to the utmost from being induced between the electrode plate 22 and the arm portion 83*a*. Also, as shown in FIG. 5, the plate surface of the electrode plate 23 and the plate surface of the electrode plate 22 are disposed so as not to be opposed to each other and further, the two electrode plates 22 and 23 are disposed in the developing frame 13 and the toner container 11, respectively, to thereby prevent capacitance from being induced between the two electrode plates 22 and 23.

That is, in the process cartridge B, the electrode plate 26 for wiring is provided on the developing frame 13, whereby it is avoided for the electrode plate 22 on the voltage-application side and the electrode plate 23 on the output side to be disposed on the same frame and further, the induction of capacitance is prevented to thereby prevent the lowering of the accuracy of toner-remaining-amount detection.

Figure 6:
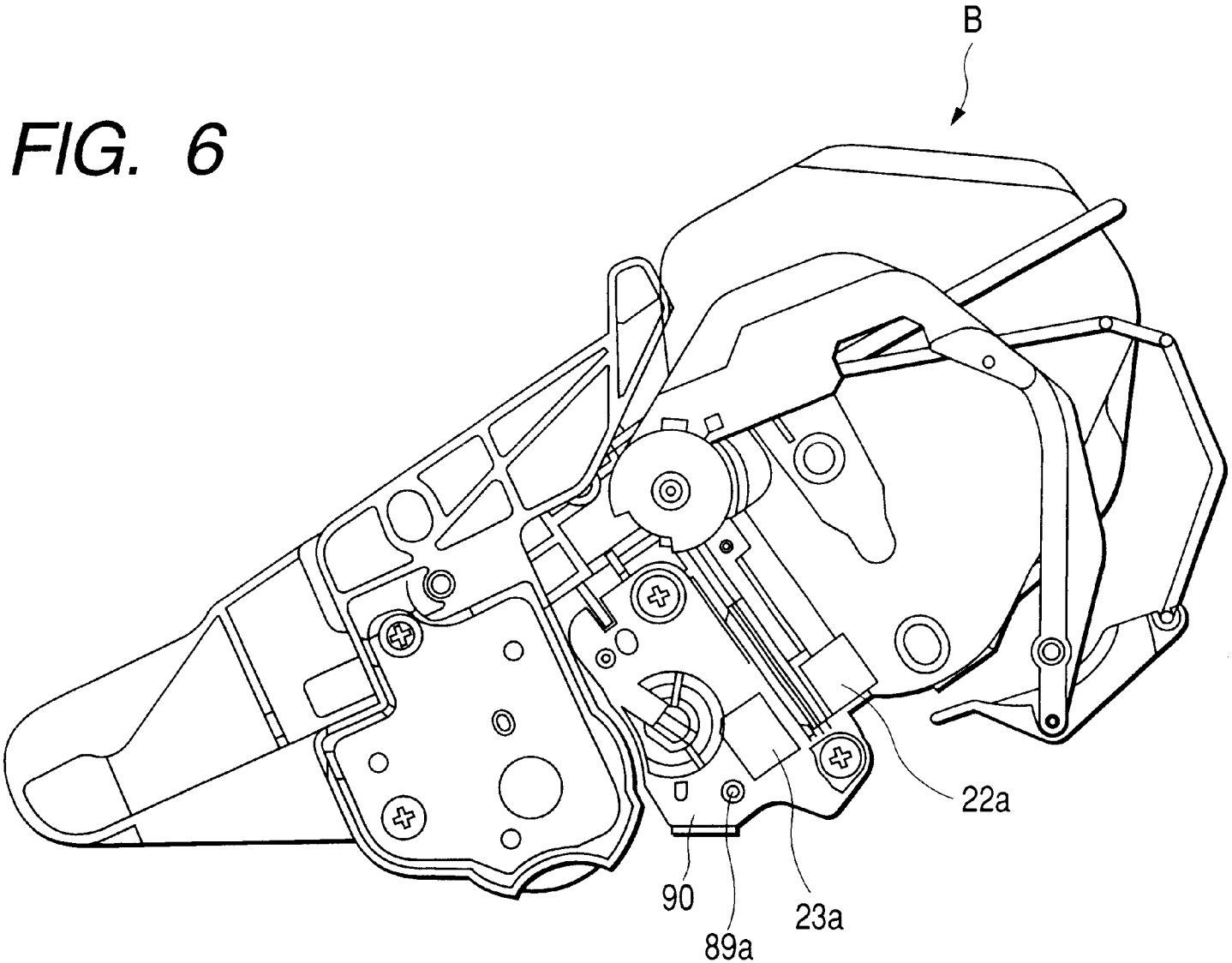
FIG. 6 is a right side view of the process cartridge showing the disposition of an external contact provided on a side of the process cartridge.
Figure 7:
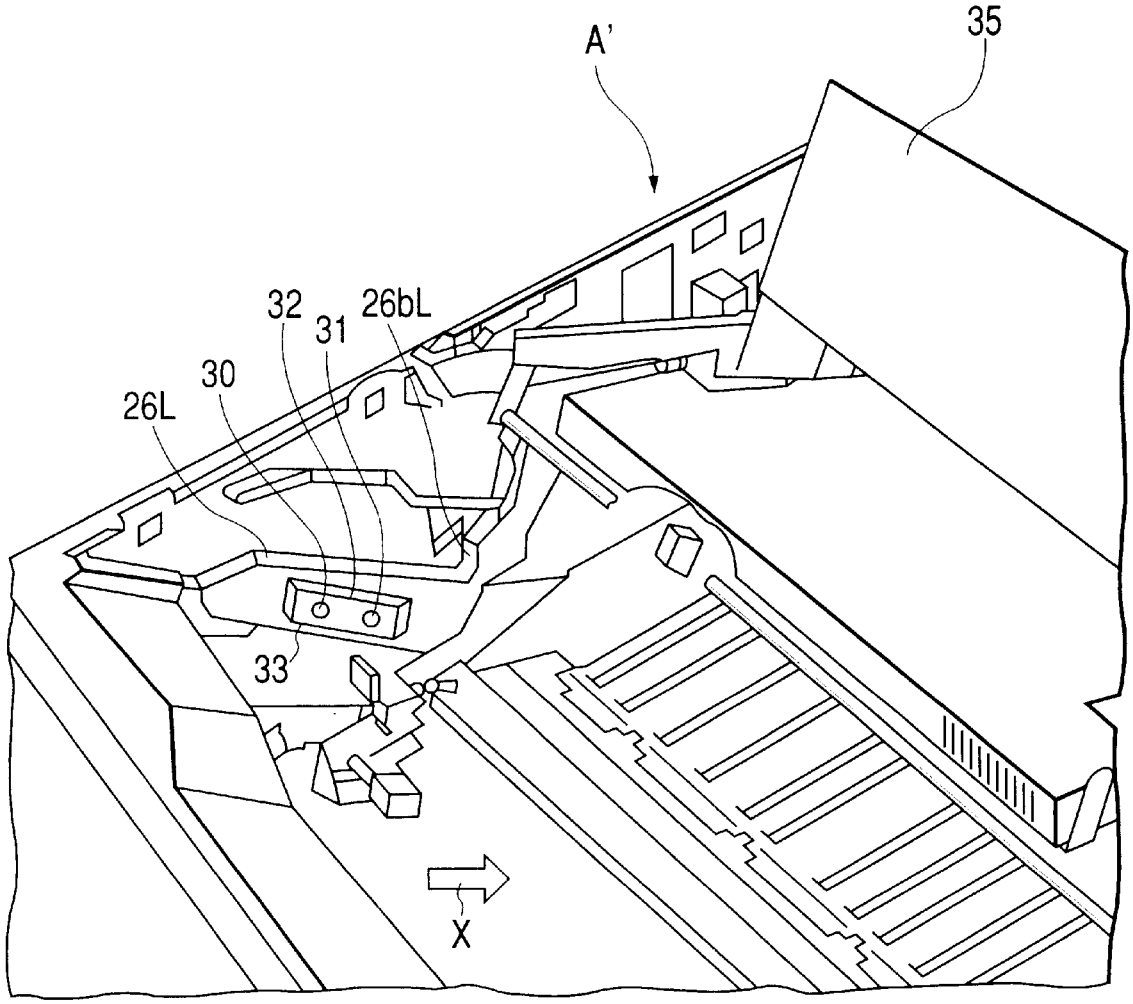
FIG. 7 is a perspective view showing a state in which the opening-closing member of the image forming apparatus having the successive toner-remaining-amount detecting circuit is opened.

On a side of the process cartridge B assembled as described above, the external contacts 22*a* and 23*a* of the second detecting means are disposed side by side in proximity to each other with the coupled surface of the developing frame 13 and the toner container 11 as the boundary, as shown in FIG. 6. Also, as shown in FIG. 7, electrical contacts 30 and 31 are provided in the image forming apparatus A' corresponding to the external contacts 22*a* and 23*a*, respectively. These electrical contacts 30 and 31 are attached to a contact holder 32 and are made into an integral contact unit 33, which is incorporated in the frame of the main body of the image forming apparatus A'.

When the process cartridge B is inserted in the direction indicated by the arrow X and is mounted to the main body of the image forming apparatus A', the external contacts 22*a* and 23*a* contact with and are electrically connected to the electrical contacts 30 and 31, respectively, disposed in the main body of the image forming apparatus A'.

In the present invention, the external contacts 22*a* and 23*a* are disposed on the same side of the process cartridge B and in proximity to each other and therefore, the contact unit 33 provided in the image forming apparatus A' can be made correspondingly small and the downsizing of the image forming apparatus A' and a reduction in cost can be achieved.

Also, as shown in FIG. 3, the wire laying portions 36 and 37 of the wires from the contact unit 33 to the developer amount detecting circuit 200 can be made short, and the lowering of the accuracy of toner amount detection attributable to the irregularity of the capacitance between the wires can be prevented.

Further, in the present embodiment, the wiring of the electrodes is done in such a manner that the external contact 23*a* of the process cartridge B is provided in the developing frame 13 and the external contact 22*a* thereof is provided in the toner container 11 so that little or no capacitance exists between the arm portion 81*a* of the first electrode 81 which is a wire laying portion and the electrode plate 26. Therefore, the irregularity of capacitance by the toner coming into the wire laying portion for the electrodes in the interior of the process cartridge B can be restrained, and this leads to an improvement in detection accuracy.

While in the present embodiment, the external contact 23*a* on the output side is disposed in the developing frame 13 and the external contact 22*a* on the input side is disposed in the toner container 11, such disposition is not restrictive, but the external contact 23*a* can be disposed in one of the developing frame 13 and the toner container 11 and the external contact 22*a* can be disposed in the other of the developing frame 13 and the toner container 11.

Figure 8:
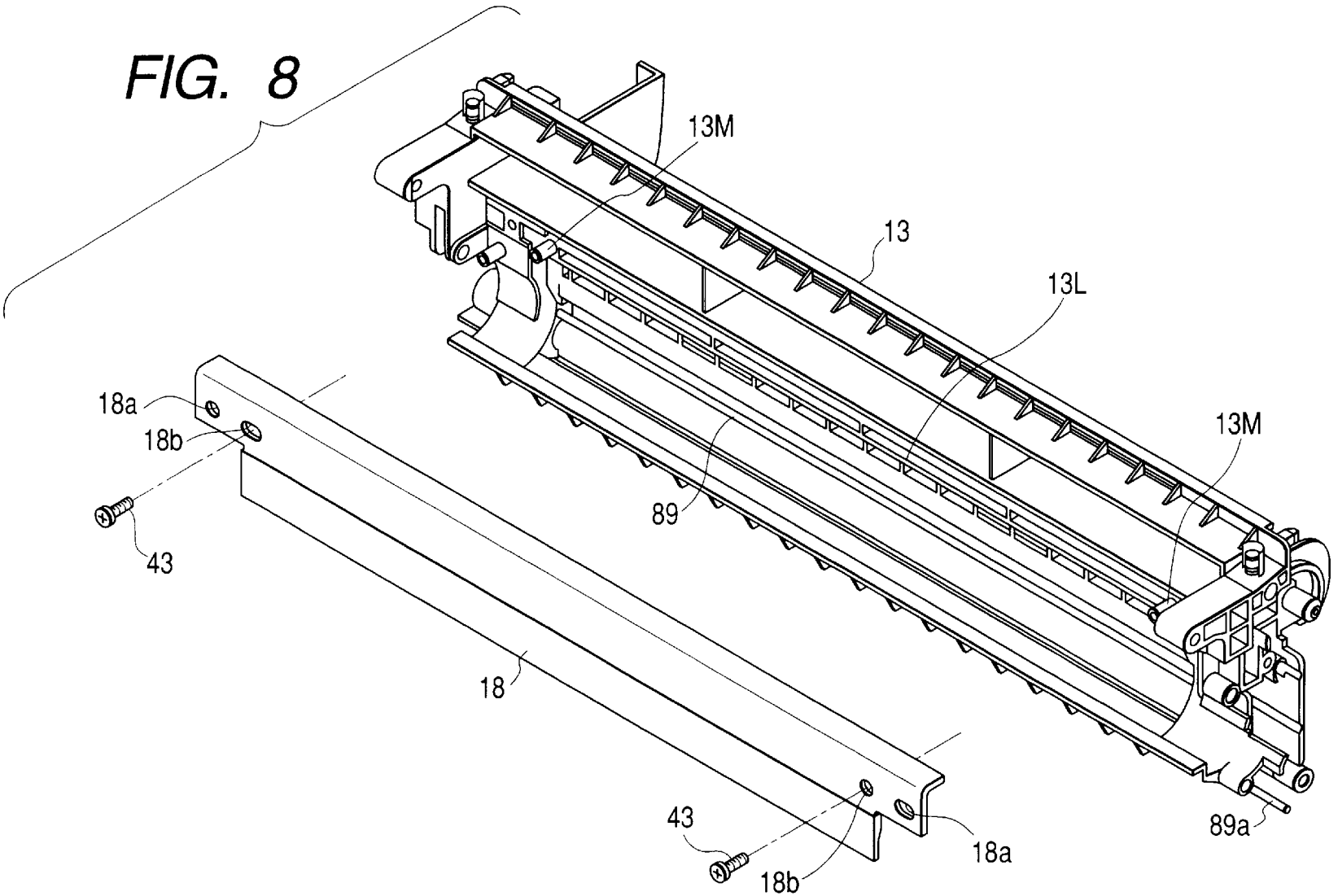
FIG. 8 is an exploded perspective view for showing the manner in which an antenna rod, which is second detecting means, and a developing blade, are mounted.

FIG. 8 is an exploded perspective view for showing the manner in which the antenna rod 89, which is the first detecting means and the developing blade 18 are attached. As shown in FIG. 8, the antenna rod 89 is inserted into an aperture formed near a bearing for holding the developing roller 12 provided in the developing frame 13, whereby it is directly attached to the developing frame 13. At this time, the antenna rod 89 forms at least a straight line over a range in which the developing roller 12 exists, and is disposed substantially parallel to the developing roller 12.

Also, the antenna rod 89 forms a crank-like shape and therefore, one end side thereof (this side as viewed in FIG. 8) is disposed so as to lie as an external contact 89*a* on the underside of the developing frame 13, and is electrically connected to the electrical contact of the main body of the image forming apparatus A as the output contact of the first detecting means.

Also, the developing frame 13 is provided with a developing-frame attaching surface 13L, on the opposite end portions of which there are provided positioning bosses 13M. The developing blade 18 is fixed to the developing frame 13 by the positioning bosses 13M being fitted into positioning apertures 18*a* formed in the opposite ends thereof, and small screws 43 being inserted into screw holes 18*b* and screwed into the internally threaded holes (not shown) of the developing frame 13. As attaching means for each electrode, use can be made of screws, an adhesive agent, caulking, insert molding or the like.

While in the present embodiment, each electrode is made of a non-magnetic stainless steel material (SUS material) so as not to affect the circulation of the toner and is provided in the developing frame 13, any electrode made of a non-magnetic material having chargeability, such as an aluminum material or electrically conductive resin, can be applied. It is also possible to subject the developing frame 13 to treatment such as vapor deposition or printing, and two-color-shape an electrically conductive paint layer, a vapor-deposited layer or electrically conductive resin directly provided on the frame to thereby form an electrically conducting portion In this case, as compared with a case where an electrode comprising a discrete member is attached, attachment tolerance and part tolerance decrease and therefore, an improvement in positional accuracy can be achieved.

The process cartridge of the present embodiment, as described above, is provided with two developer amount detecting means, whereby it can cope with any of the main body of the image forming apparatus A' of a type having a mechanism for successively detecting the amount of toner and the main body of the image forming apparatus A having no successively detecting mechanism and effecting only the detection of the absence of the toner.

(Description of the Mounting of the Process Cartridge to the Image Forming Apparatus)

Figure 11:
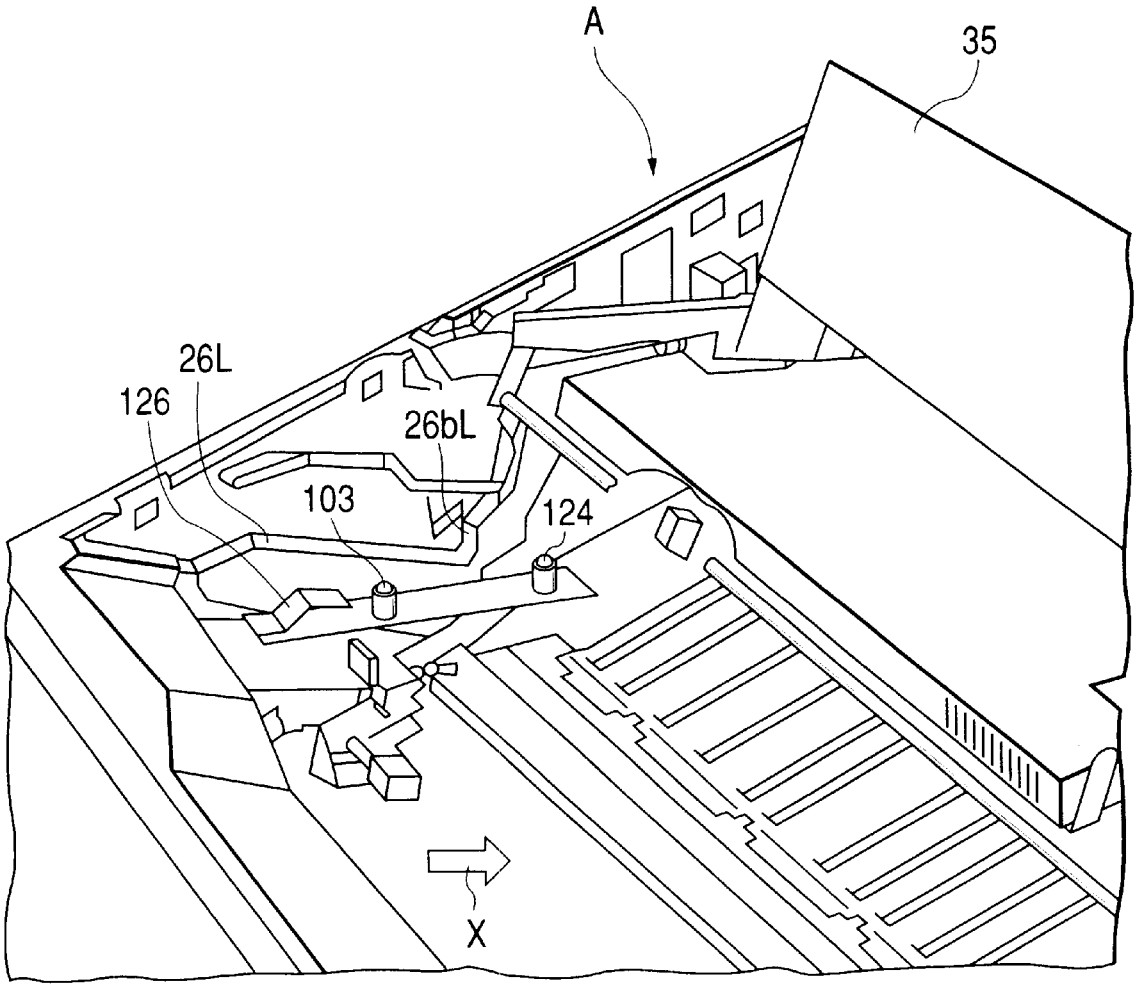
FIG. 11 is a perspective view showing a state in which the opening-closing member of an image forming apparatus provided with a toner-presence-or-absence detecting circuit (mechanism) is opened.
Figure 12A:
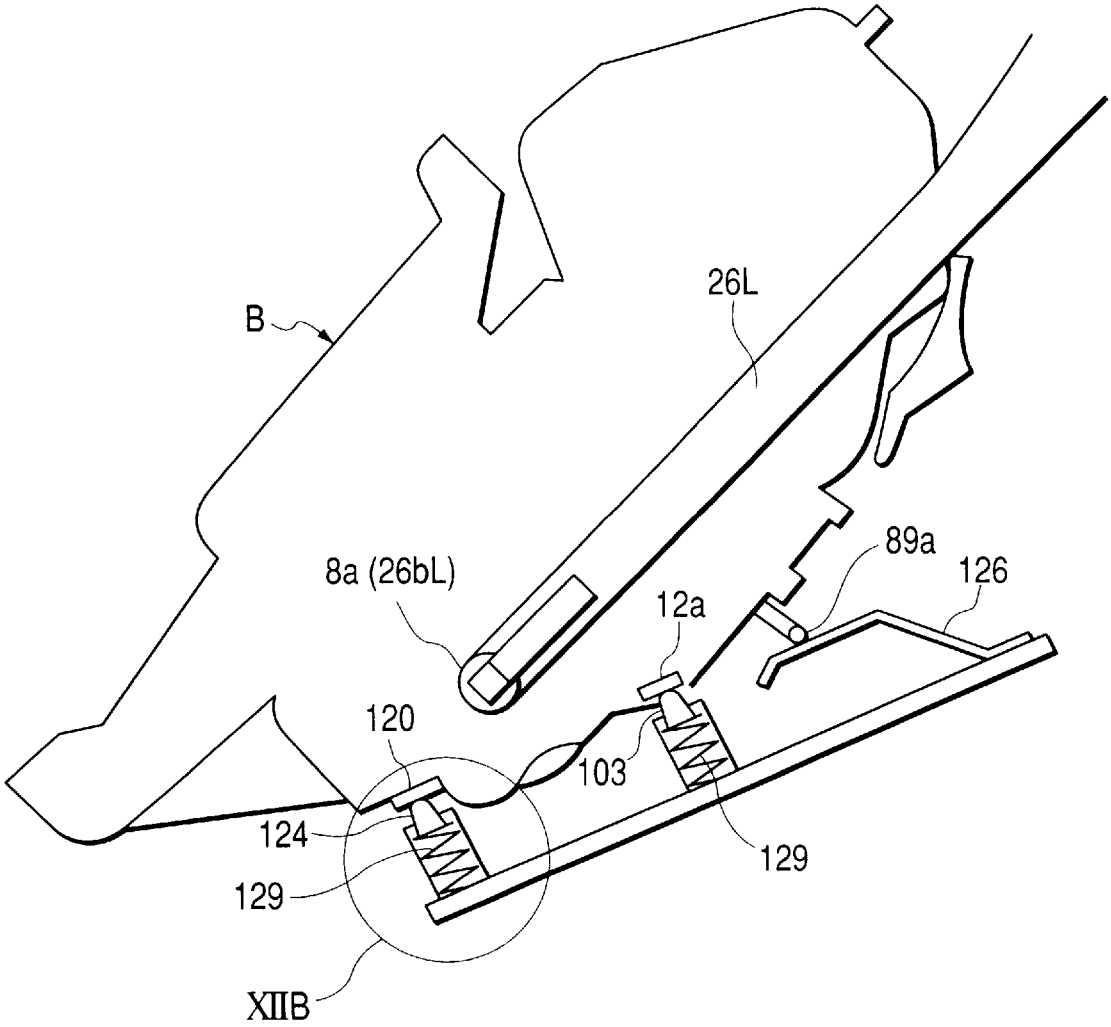
FIG. 12A is a schematic cross-sectional view showing the manner in which the process cartridge is mounted to the image forming apparatus provided with the toner-presence-or-absence detecting circuit (mechanism).
Figure 12B:
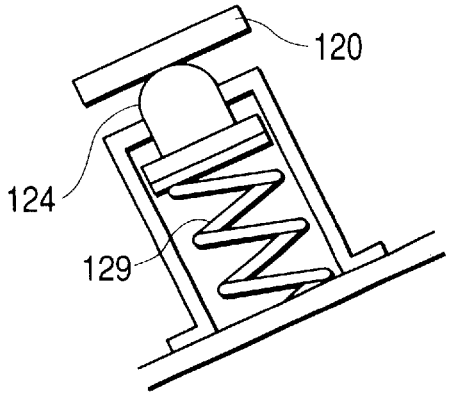
FIG. 12B is an enlarged view of an encircled portion XIIB in FIG. 12A.
Figure 13:
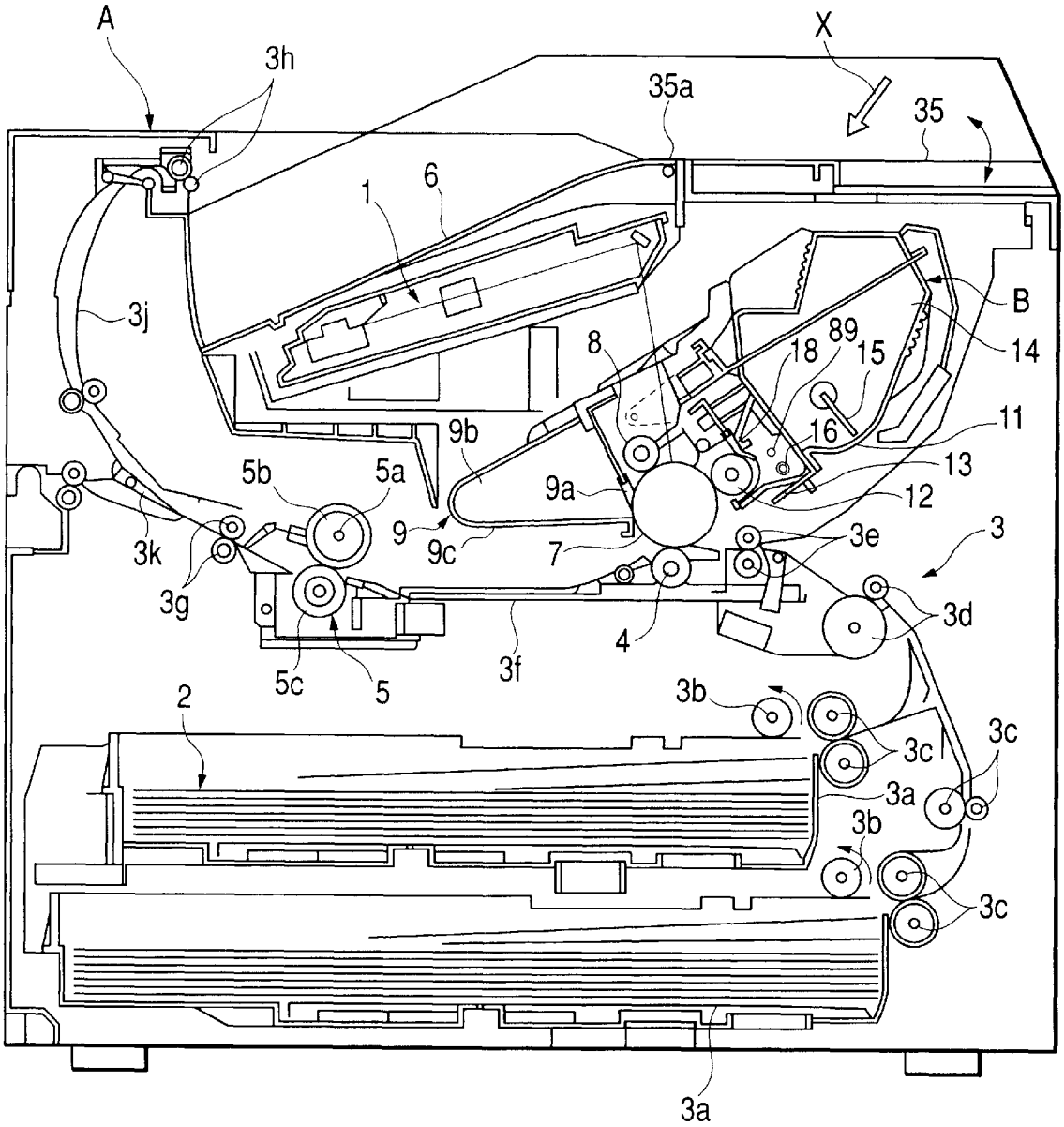
FIG. 13 is a schematic view showing in longitudinal cross-section a state in which the process cartridge is being mounted to the image forming apparatus provided with the toner presence or absence detecting circuit (mechanism).

Reference is now made to FIGS. 11 to 13 to describe a method of mounting the process cartridge B to the image forming apparatus A for the electrode rod detection type. The image forming apparatus A is an electrophotographic image forming apparatus corresponding to a process cartridge of the electrode-rod-detection type that detects the toner-absent state by an antenna rod. The image forming apparatus A is provided with a toner-presence-or-absence detecting circuit (mechanism) for detecting the presence or absence of the toner in the main body thereof.

FIG. 13 is a schematic view showing the longitudinal cross-section of the image forming apparatus A in a state in which the process cartridge B of the present invention is mounted thereto. The image forming apparatus A is substantially similar in construction to the image forming apparatus A' shown in FIG. 1 and therefore, the similar portions thereof are given the same reference characters and need not be described. The image forming apparatus A is substantially similar in construction to the image forming apparatus A' with the exception that it has a two-stage feed cassette 3*a* at the bottom of the main body thereof and the fixing means 5 comprises a driving roller 5*c* and a fixing roller 5*b* containing a heater 5*a* therein.

FIG. 11 is a perspective view showing the opening-closing member 35 of the image forming apparatus A as it is opened. Whereas shown in FIG. 11, the opening-closing member 35 is opened about a hinge 35*a* (see FIG. 13), forwardly descent left and right guide rails 26L and 26R (26R being not shown) are seen on the left and right inner walls of the image forming apparatus A. As shown in FIG. 12A, left and right cylindrical guides 8*a*, coaxial with the photosensitive drum 7, and an elongate posture determining guide (not shown), behind the cylindrical guides 8*a* as viewed in the direction of mounting of the process cartridge B to the main body of the apparatus, are inserted into the guide rails 26L and 26R, and the cylindrical guides 8*a* are fitted into the positioning grooves 26bL and 26bR (26bR being not shown) of the image forming apparatus A, whereby the process cartridge B is mounted to the image forming apparatus A.

When conversely, the process cartridge B mounted to the image forming apparatus A is to be detached, the process cartridge B is pulled out along the guide rails 26L and 26R by a procedure converse to what has been described above.

When the process cartridge B is mounted to the image forming apparatus A, the external contact 89*a* provided on the process cartridge B contacts the detection contact 126 of the main body of the image forming apparatus A, and the external contact 89*a* and the detection contact 126 are electrically connected together. As shown in FIG. 12A, the external contact 89*a* is disposed so as to lie on the underside of the process cartridge B, and the detection contact 126 is an electrically conductive leaf spring member provided below and beside the guide rail 26L. The detection contact 126 is disposed at the bottom of a mount portion on which the process cartridge B is mounted when the opening-closing member 35 of the image forming apparatus A is opened (see FIG. 11), and is adapted to be biased toward the external contact 89*a* lying on the underside of the process cartridge B by the leaf spring. The detection contact 126 is connected to the toner-remaining-amount detecting mechanism of the main body of the image forming apparatus A, and detects the remaining amount of toner in the process cartridge B by an electrical signal from the external contact 89*a*. Further, by the electrical signal from the external contact 89*a*, it detects whether the process cartridge B is mounted to the main body of the image forming apparatus A. This electrical signal is an electrical signal conforming to the capacitance produced between the antenna rod 89 and the developing roller 12.

Also, as shown in FIG. 12A, on the left and right sides of the cylindrical guide 8*a* of the process cartridge B, there are provided an electrically conductive charging bias contact 120 electrically connected to the shaft of the charging roller 8 to apply a charging bias from the main body of the image forming apparatus A to the charging roller 8, and an electrically conductive developing bias contact 12*a* electrically connected to the developing roller 12 to apply a developing bias from the main body of the image forming apparatus A to the developing roller 12. On the other hand, on the front and rear sides of the positioning groove 26bL of the main body of the image forming apparatus A, there are provided a charging contact member 124 and a developing contact member 103 correspondingly to the charging bias contact 120 and the developing bias contact 12*a*, respectively. The charging contact member 124 and the developing contact member 103 are biased toward the charging bias contact 120 and the developing bias contact 12*a*, respectively, by compression springs 129 as shown in FIG. 12B.

When the process cartridge B is mounted to the image forming apparatus A corresponding to the developer amount detecting means provided by the antenna rod 89, the first to third electrodes 81, 82, and 83, which are the second detecting means do not function. That is, in the main body of the image forming apparatus A, there are not provided an electrical contact corresponding to the external contact 23*a* connected to the first and third electrodes 81 and 83 and an electrical contact corresponding to the external contact 22*a* connected to the second electrode 82. Therefore, the external contacts 22*a* and 23*a* are not electrically connected to the main body of the image forming apparatus A. Accordingly, when the process cartridge B of the present invention is mounted to the main body of the image forming apparatus A, the first detecting means, which is the developer amount detecting means provided by the antenna rod 89 functions to produce in the image forming apparatus A an electrical signal for indicating of the presence or absence of the remaining amount of the toner and as to whether the process cartridge B is mounted.

Reference is now had to FIG. 7 to describe a method of mounting the process cartridge B to the image forming apparatus A'.

The image forming apparatus A' is an electrophotographic image forming apparatus corresponding to a process cartridge of the electrode-plate-detection type that detects the remaining amount of toner by an electrode plate. The image forming apparatus A' is provided with a developer-amount detecting circuit for successively detecting the remaining amount of toner in the main body thereof. FIG. 7 is a perspective view showing the opening-closing member 35 of the image forming apparatus A as it is opened.

Like the image forming apparatus A, the opening-closing member 35 is opened about a hinge 35*a*, and left and right cylindrical guides 8*a* coaxial with the photosensitive drum 7 and elongate posture determining guides (not shown) behind these cylindrical guides 8*a* as viewed in the direction of mounting of the process cartridge B to the main body of the apparatus are inserted into guide rails 26L and 26R, and the cylindrical guides 8*a* are fitted into the positioning grooves 26bL and 26bR (26bR being not shown) of the image forming apparatus A' to thereby mount the process cartridge B to the image forming apparatus A'. When the process cartridge B mounted to the image forming apparatus A' is to be detached, the process cartridge B is pulled out along the guide rails 26L and 26R by the procedure opposite to what has been described above.

When the process cartridge B is mounted to the image forming apparatus A', the external contacts 22*a* and 23*a* provided on the side of the process cartridge B contact the electrical contacts 30 and 31, respectively, of the main body of the image forming apparatus A', and the external contacts 22*a*, 23*a* and the electrical contacts 30, 31 are electrically connected together. As shown in FIG. 7, the electrical contacts 30 and 31 are attached to a contact holder 32 and are connected to the developer amount detecting circuit 200 in the main body of the image forming apparatus A'. Also, the contact holder 32 is disposed on the side wall of a mount portion on which the process cartridge B is mounted when the opening-closing member 35 of the image forming apparatus A' is opened. The image forming apparatus A' successively detects the remaining amount of toner in the process cartridge B by electrical signals from the external contacts 22*a* and 23*a*. Further, it detects whether the process cartridge B is mounted to the main body of the image forming apparatus A' , by the electrical signals from the external contacts 22*a* and 23*a*. These electrical signals are electrical signals conforming to the capacitance produced between the first and third electrodes 81 and 83 and the second electrode 82 and the capacitance produced between the first and third electrodes 81 and 83 and the developing roller 12.

When the process cartridge B is mounted to the image forming apparatus A' corresponding to the developer amount detecting means provided by the electrode plate, the antenna rod 89 which is the first detecting means does not function. That is, an electrical contact corresponding to the external contact 89*a* of the antenna rod 89 is not provided in the main body of the image forming apparatus A' and therefore, the external contact 89*a* is not electrically connected to the main body of the image forming apparatus A'. Accordingly, when the process cartridge B of the present invention is mounted to the main body of the image forming apparatus A', the second detecting means provided by the first to third electrodes 81, 82 and 83 function to produce in the image forming apparatus A' an electrical signal indicating the remaining amount of toner and as to whether the process cartridge B has been mounted.

Also, according to the process cartridge B of the present invention, there is constructed an electrophotographic image forming system in which the process cartridge B is selectively mounted to the image forming apparatus A or the image forming apparatus A' to thereby form an image on the recording medium 2.

As described above, in the process cartridge B according to the present embodiment, the antenna rod 89, which is the first detecting means, and the electrodes 81, 82 and 83, which are the second detecting means, are attached to the developing frame 13 and therefore, the process cartridge B has the interchangeability of being mountable to both of the electrophotographic image forming apparatus A of the electrode rod detection type and the electrophotographic image forming apparatus A' of the electrode plate detection type.

To a user having both of the image forming apparatus A of the electrode rod detection type and the image forming apparatus A' of the electrode plate detection type, it has heretofore been necessary to manage the remaining amounts of toner in the respective image forming apparatuses and have two kinds of process cartridges in stock. The process cartridge B of the present invention, however, makes it unnecessary to have two kinds of process cartridges corresponding to the respective image forming apparatuses in stock, and is convenient for management and excellent in usability.

The process cartridge B of the present embodiment is of such structure that one end (the external contact 89*a*) of the antenna rod 89, which is the first detecting means, is disposed so as to lie on the underside of the cartridge and the external contacts 22*a* and 23*a* connected to the electrodes, which are the second detecting means, are provided on the side of the cartridge. As described above, the external contact 89*a* and the external contacts 22*a*, 23*a* are provided on the different surfaces of the cartridge and therefore, the external contacts 22*a*, 23*a* are prevented from contacting the detection contact 126 by mistake when the process cartridge B is mounted to the image forming apparatus A, and the external contact 89*a* is prevented from contacting with the electrical contacts 30 and 31 by mistake when the process cartridge B is mounted to the image forming apparatus A'.

Since in the present embodiment, all of the electrodes 81, 82 and 83 providing the second detecting means are attached to the developing frame 13, the accuracy of the intervals among the respective electrodes can be made good. Also, since all of the first to third electrodes 81, 82 and 83 can be attached from the joined side of the developing frame 13 with the toner container 11, the attachment efficiency is also good.

Further, by the first to third electrodes 81, 82 and 83 being attached to the developing frame 13 and disposed near the developing sleeve 12 and the developing blade 18, each electrode and the developing sleeve 12 and the developing blade 18 can be accurately positioned relative to one another, and the time when a blank area on an image is created can be detected accurately.

Also, by the antenna rod 89 as the first detecting means being attached to the developing frame 13 and disposed near the developing sleeve 12 and the developing blade 18, the time when the developer is on the verge of depletion can be detected so that the time when a blank area on an image is created can be detected accurately.

While in the present embodiment, there has been shown the form of the process cartridge B in which the photosensitive drum 7, which is an image bearing member, and the developing means 10 are constructed integrally with each other, of course, the present invention is not restricted to the process cartridge, but can also be applied to a developing device in which the developing means 10, etc. are constructed as an integral developing unit 20.

As described above, the main embodiment of the present invention is a process cartridge B detachably mountable to the main body of the electrophotographic image forming apparatus A and the main body of the electrophotographic image forming apparatus A' differing in function from the main body of the image forming apparatus A, and having a photosensitive drum 7, a developing roller 12 for developing an electrostatic latent image formed on the photosensitive drum 7, a toner containing portion 14 containing therein a toner used to develop the electrostatic latent image by the developing roller 12, and an antenna rod 89 disposed along the lengthwise direction of the developing roller 12 and having one end thereof (external contact 89*a*) exposed from a cartridge frame. Further, the process cartridge B has first, second and third electrodes 81, 82 and 83 disposed along the lengthwise direction of the developing roller 12, and the first and third electrodes 81 and 83 and the second electrode 82 are electrically connected to external contacts 23*a* and 22*a* exposed from the cartridge frame. When the process cartridge B is mounted to the main body of the image forming apparatus A, the external contact 89*a* is electrically connected to a detection contact member 126 provided in the main body of the image forming apparatus A. Then it produces an electrical signal for indicating that the process cartridge B has been mounted to the main body of the image forming apparatus A. Also, when the process cartridge B is mounted to the main body of the image forming apparatus A', the external contact 89*a* is not electrically connected to the interior of the main body of the image forming apparatus A'. On the other hand, when the process cartridge B is mounted to the main body of the image forming apparatus A', the external contacts 22*a* and 23*a* are electrically connected to electrical contacts 30 and 31, respectively, provided in the main body of the image forming apparatus A'. Then, they produce an electrical signal for the main body of the image forming apparatus A' to successively detect the remaining amount of developer. When the process cartridge B is mounted to the main body of the image forming apparatus A, the external contacts 22*a* and 23*a* are not electrically connected to the interior of the main body of the image forming apparatus A.

Also, the external contact 89*a* which is one end of the antenna rod 89 connected to the detection contact 126 and the external contacts 22*a* and 23*a*, which are the electrical contacts of the cartridge, connected to the first to third electrodes 81, 82 and 83 are provided on the different surfaces of the cartridge frame. That is, the external contacts 22*a* and 23*a* which are the electrical contacts of the cartridge are disposed so as to lie on the side of the cartridge frame so that the external contact 89*a* may lie on the underside of the cartridge frame when the process cartridge B is mounted to the image forming apparatus A or A'.

According to the process cartridge of the above-mentioned embodiment, the antenna rod, which is the first detecting means, and the electrode plates which are the second detecting means are provided and therefore, the process cartridge can be mounted to both of an electrophotographic image forming apparatus of the electrode-rod-detection type and an electrophotographic image forming apparatus of the electrode-plate-detection type.

According to the above-described present invention, there can be provided a process cartridge detachably mountable to the main bodies of electrophotographic image forming apparatuses differing in function from each other, and an electrophotographic image forming system using the afore-described process cartridge.

While the invention has been described with reference to the structure disclosed herein, it is not confined to the details set forth and this application is intended to cover such modifications or changes as may come within the purposes of the improvements or the scope of the following claims.

What is claimed is:

1. A process cartridge detachably mountable to a main body of a first electrophotographic image forming apparatus and a main body of a second electrophotographic image forming apparatus differing in function from the main body of said first electrophotographic image forming apparatus, said process cartridge comprising:

(a) an electrophotographic photosensitive member;

(b) a developing roller for developing an electrostatic latent image formed on said electrophotographic photosensitive member;

(c) a developer containing portion containing therein a developer to be used to develop the electrostatic latent image by said developing roller;

(d) a first electrically conductive member disposed along a lengthwise direction of said developing roller and having one end thereof exposed from a cartridge frame, said one end being electrically connected to a first main body contact provided in the main body of said first electrophotographic image forming apparatus when said process cartridge has been mounted to the main body of said first electrophotographic image forming apparatus, and producing an electrical signal for indicating that said process cartridge has been mounted to the main body of said first electrophotographic image forming apparatus, said one end being not electrically connected to an interior of the main body of said second electrophotographic image forming apparatus when said process cartridge has been mounted to the main body of said second electrophotographic image forming apparatus; and (e) a second electrically conductive member disposed along the lengthwise direction of said developing roller and electrically connected to a cartridge electrical contact exposed from said cartridge frame, said cartridge electrical contact being electrically connected to a second main body contact provided in the main body of said second electrophotographic image forming apparatus when said process cartridge has been mounted to the main body of said second electrophotographic image forming apparatus, and producing an electrical signal for the main body of said second electrophotographic image forming apparatus to successively detect the remaining amount of said developer, said cartridge electrical contact being not electrically connected to an interior of the main body of said first electrophotographic image forming apparatus when said process cartridge is mounted to the main body of said first electrophotographic image forming apparatus.

2. A process cartridge according to claim 1, wherein said electrical signal produced by said first electrically conductive member is an electrical signal conforming to a capacitance existing between said first electrically conductive member and said developing roller.

3. A process cartridge according to claim 1 or 2, wherein said first electrically conductive member further produces an electrical signal representing a condition that the remaining amount of said developer has reached a predetermined remaining amount and to be detected by the main body of said first electrophotographic image forming apparatus.

4. A process cartridge according to claim 1 or 2, wherein said electrical signal produced by said second electrically conductive member is an electrical signal conforming to a capacitance existing between said second electrically conductive member and said developing roller.

5. A process cartridge according to claim 1 or 2, wherein said second electrically conductive member is a plate-shaped member.

6. A process cartridge according to claim 1 or 2, wherein the one end of said first electrically conductive member which is connected to the first main body contact and the cartridge electrical contact connected to said second electrically conductive member are provided on different surfaces of the process cartridge.

7. A process cartridge according to claim 6, wherein when said process cartridge has been mounted to the main body of said first or second electrophotographic image forming apparatus, said one end is disposed so as to lie on an underside of the process cartridge, and said cartridge electrical contact is disposed so as to lie on a side of the process cartridge.

8. A process cartridge according to claim 1 or 2, wherein the material of said first electrically conductive member is a non-magnetic stainless steel material or an aluminum material, and the material of said second electrically conductive member is a non-magnetic stainless steel material, an aluminum material, electrically conductive resin, or an electrically conductive paint layer or a vapor-deposited layer directly provided on the cartridge frame.

9. An electrophotographic image forming system for forming an image on a recording medium by use of a process cartridge, said electrophotographic image forming system comprising:

an electrophotographic photosensitive member;

a developing roller for developing an electrostatic latent image formed on said electrophotographic photosensitive member;

a developer containing portion for containing therein a developer to be used to develop said electrostatic latent image by said developing roller;

a first electrically conductive member disposed along a lengthwise direction of said developing roller and having one end thereof exposed from a cartridge frame, said one end being electrically connected to a first main body contact provided in a main body of a first electrophotographic image forming apparatus when said process cartridge has been mounted to the main body of said first electrophotographic image forming apparatus, and producing an electrical signal for indicating that said process cartridge has been mounted to the main body of said first electrophotographic image forming apparatus, said one end being not electrically connected to an interior of a main body of a second electrophotographic image forming apparatus when said process cartridge has been mounted to the main body of said second electrophotographic image forming apparatus; and a second electrically conductive member disposed along the lengthwise direction of said developing roller and electrically connected to a cartridge electrical contact exposed from said cartridge frame, said cartridge electrical contact being electrically connected to a second main body contact provided in the main body of said second electrophotographic image forming apparatus when said process cartridge has been mounted to the main body of said second electrophotographic image forming apparatus, and producing an electrical signal for the main body of said second electrophotographic image forming apparatus to successively detect the remaining amount of said developer, said cartridge electrical contact being not electrically connected to an interior of the main body of said first electrophotographic image forming apparatus when said process cartridge has been mounted to the main body of said first electrophotographic image forming apparatus;

said process cartridge being selectively mounted to said first electrophotographic image forming apparatus and said second electrophotographic image forming apparatus to thereby form an image on said recording medium.

10. An electrophotographic image forming system according to claim 9, wherein said electrical signal produced by said first electrically conductive member is an electrical signal conforming to the capacitance existing between said first electrically conductive member and said developing roller.

11. An electrophotographic image forming system according to claim 9 or 10, wherein said first electrically conductive member further produces an electrical signal representing that condition that the remaining amount of said developer has reached a predetermined remaining amount and to be detected by the main body of said first electrophotographic image forming apparatus.

12. An electrophotographic image forming system according to claim 9 or 10, wherein said electrical signal produced by said second electrically conductive member is an electrical signal conforming to the capacitance existing between said second electrically conductive member and said developing roller.

13. An electrophotographic image forming system according to claim 9 or 10, wherein said second electrically conductive member is a plate-shaped member.

14. An electrophotographic image forming system according to claim 9 or 10, wherein the material of said first electrically conductive member is a non-magnetic stainless steel material or an aluminum material, and the material of said second electrically conductive member is a non-magnetic stainless steel material, an aluminum material, electrically conductive resin or an electrically conductive paint layer or a vapor-deposited layer directly provided on the cartridge frame.

* * * * *